US008649721B2

(12) United States Patent
Kosasa

(10) Patent No.: US 8,649,721 B2
(45) Date of Patent: Feb. 11, 2014

(54) PROCESSING APPARATUS AND CARTRIDGE

(75) Inventor: Hideaki Kosasa, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 174 days.

(21) Appl. No.: 13/427,321

(22) Filed: Mar. 22, 2012

(65) Prior Publication Data

US 2012/0269542 A1 Oct. 25, 2012

(30) Foreign Application Priority Data

Apr. 25, 2011 (JP) ..... 2011-097682

(51) Int. Cl.
*G03G 21/18* (2006.01)
*G03G 15/00* (2006.01)

(52) U.S. Cl.
CPC .. *G03G 15/6585* (2013.01); *G03G 2215/00805* (2013.01)
USPC ..... 399/341; 219/216

(58) Field of Classification Search
USPC ..... 399/341
See application file for complete search history.

(56) References Cited

U.S. PATENT DOCUMENTS

| | | | | |
|---|---|---|---|---|
| 5,068,684 | A * | 11/1991 | Abe et al. | 355/406 |
| 5,099,288 | A * | 3/1992 | Britto et al. | 399/320 |
| 5,887,238 | A * | 3/1999 | Matsuzoe et al. | 399/336 |
| 5,956,554 | A * | 9/1999 | Yanashima et al. | 399/328 |
| 7,783,242 | B2 | 8/2010 | Chigono et al. | |
| 2007/0147917 | A1 | 6/2007 | Chigono et al. | |
| 2012/0224898 | A1* | 9/2012 | Amita et al. | 399/341 |
| 2012/0312909 | A1* | 12/2012 | Nishihiro | 242/347.2 |

FOREIGN PATENT DOCUMENTS

| | | |
|---|---|---|
| JP | 2002-120960 A | 4/2002 |
| JP | 2007-086747 A | 4/2007 |

* cited by examiner

*Primary Examiner* — Walter L Lindsay, Jr.
*Assistant Examiner* — Philip Marcus T Fasul
(74) *Attorney, Agent, or Firm* — Fitzpatrick, Cella, Harper & Scinto

(57) ABSTRACT

A surface processing apparatus includes a heating unit and a detachably mountable film cartridge. The film cartridge is provided with a first opening portion into which the heating unit proceeds, and an operational portion disposed in a casing, for acting on a shutter of the heating unit to move the shutter between a closing position (first position) and an opening position (second position). The heating unit proceeds into the casing through the first opening portion with the shutter being in the closing position, and the operational portion acts on the shutter in the casing to move the shutter to the opening position.

4 Claims, 20 Drawing Sheets

PROCESSING APPARATUS AND CARTRIDGE

BACKGROUND OF THE INVENTION

1. Field of the Invention

The present invention relates to a processing apparatus which performs processing of heating a surface of a medium to be processed via a film, and a cartridge detachably mountable to the processing apparatus.

2. Description of the Related Art

Conventionally, many printed matters have different degrees of surface gloss depending on coverage rates thereof because a recording material and colorant have different glossiness from each other. With respect to such a printed matter mentioned above, there are proposed many kinds of methods of forming a uniform glossy surface all over the surface of the printed matter through a variety of post-processing steps, such as an application of over-coating.

Moreover, in recent years, many kinds of technologies for controlling gloss are proposed. For example, in offset printing, the following method enables a variety of expressions of gloss. That is, after printing with colorant ink, a specific portion is offset using UV curable transparent ink. Then, the printed matter is exposed to UV all over its surface so that the UV curable transparent ink is fixed. According to this method, gloss of specific portions (photographs or titles, etc.) is enhanced so that a printed matter having excellent visual effects can be output.

For an electrophotographic system, there is proposed a method in which gloss of a printed matter is enhanced all over its surface so as to obtain a photo-like recording (Japanese Patent Application Laid-Open No. 2007-086747). In this method, the surface of the printed matter, on which an image has been formed with toner, is re-heated via an endless belt having a high surface smoothness to re-use the toner. After that, the toner is cooled under a state in which the toner is brought into contact with the belt so that the toner is solidified under a state in which the smoothness of the belt is transferred to the surface of the image formed by the toner. This method makes it possible to control the gloss all over the surface of the printed matter, but it is difficult to control gloss of a part of the surface of the printed matter.

As a result of the diligent studies, the inventors of the present invention have found that a method of heating a part of a printed matter using a thermal head and a thin film is suitable for controlling gloss of a part of a surface of the printed matter on which an image has been formed by an electrophotographic system etc. According to this method, through electrical control of the thermal head, arbitrary positions on the printed matter can be heated. When a medium to be processed is a printed matter on which an image has been formed with toner by an electrophotographic system, gloss of the printed matter can be controlled at arbitrary positions thereof by heating via a film a toner image of the printed matter so as to fuse, then performing cooling and separation.

Here, because the quantity of heat to be produced by the thermal head is small, a thin film having small heat resistance is preferably used to heat a toner image. However, such a film can be deformed due to a heat contraction when being heated so that re-use of the film becomes difficult. Therefore, it is convenient to make this film disposable by enabling the film to be taken up by a take-up shaft of a take-up system.

However, when the film is made disposable as mentioned above, the film needs to be replaced by a service technician or a user. As far as the inventors of the present invention know, there is no method of containing a film or mounting a film on a main body of a surface processing apparatus, which is preferably adaptable to such a surface processing apparatus while enabling the film to be easily replaced.

It is important that mounting operations of a film are not complicated, and no dust adheres to a film or a thermal head particularly when users handle films by themselves.

SUMMARY OF THE INVENTION

In view of the above, the present invention provides a processing apparatus which processes a surface of a sheet, the processing apparatus including: a cartridge which contains a film which is pulled out from a feed shaft and taken up by a take-up shaft so as to be conveyed; a heating device which heats the sheet via the film; a mechanism which movably supports the heating device, the mechanism assuming a first attitude in which the heating device abuts against the film and a second attitude in which the heating device is separated from the film; and a shutter which covers a film abutting surface of the heating device, wherein the cartridge is provided with a first opening into which the heating device is proceedable and a second opening through which the film is brought into contact with the sheet, and wherein the heating device proceeds into the cartridge through the first opening in a state in which the heating device is covered with the shutter, and the shutter retracts from the film abutting surface of the heating device inside the cartridge.

Further features of the present invention will become apparent from the following description of exemplary embodiments with reference to the attached drawings.

DESCRIPTION OF THE EMBODIMENTS

A surface processing apparatus according to the present invention will be described in detail below with reference to the drawings.

First Embodiment

1. Basic Configuration of Surface Processing Apparatus

Figure 1:
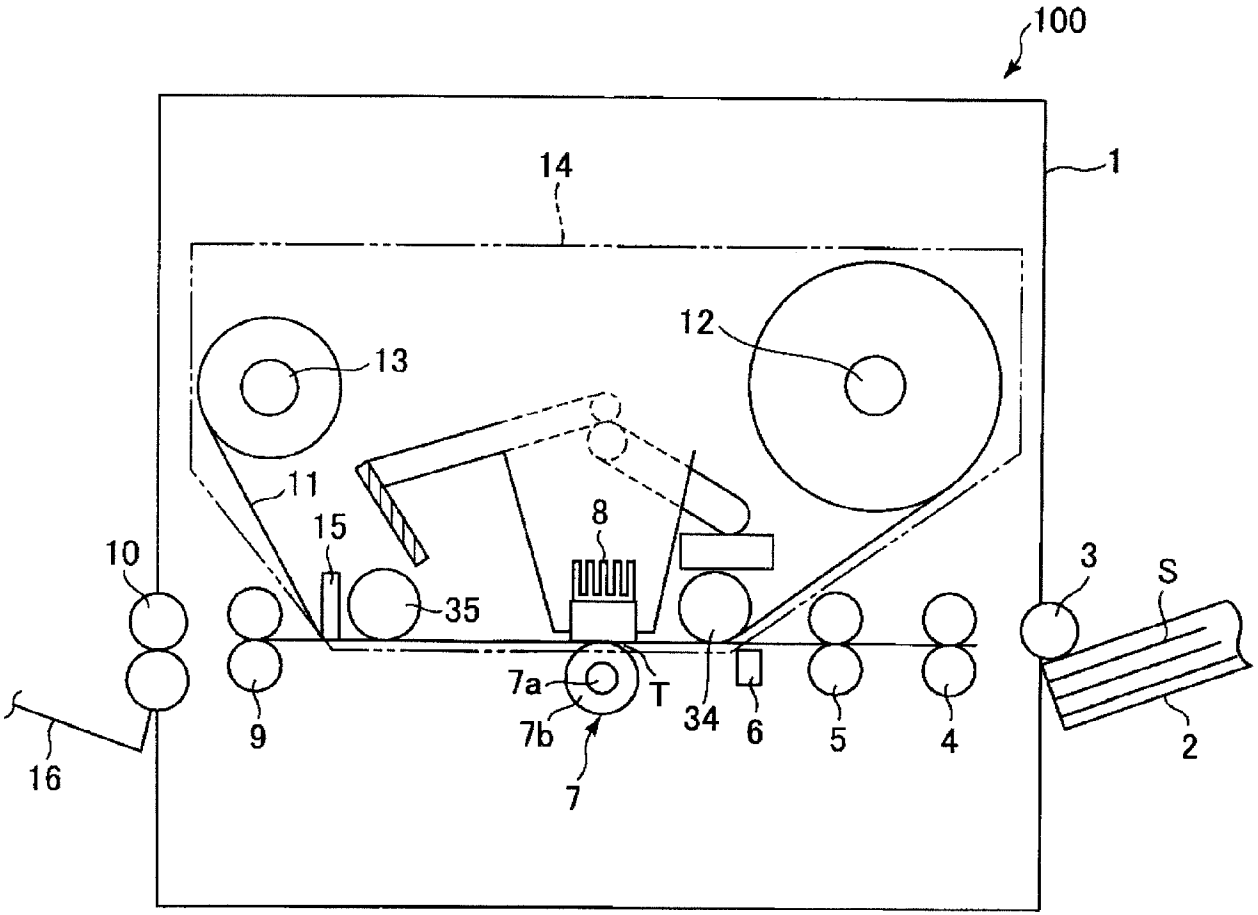
FIG. 1 is a schematic cross-sectional view of a surface processing apparatus according to an embodiment of the present invention.

FIG. 1 is a schematic cross-sectional view of a surface processing apparatus 100 according to an embodiment of the present invention. In this embodiment, the surface processing apparatus 100 performs processing (surface processing) of controlling surface characteristics of a surface of a medium S to be processed (hereinafter, also referred to as medium S) which is a recording material on which an image has been formed with thermofusible toner separately by an electrophotographic image forming apparatus.

The surface processing apparatus 100 includes an apparatus main body 1, a cassette 2 on which the media S are stacked, a feed roller 3 which separates and feeds the media S sheet by sheet from the cassette 2, and conveying roller pairs 4, 9 which nips and conveys the medium S. The surface processing apparatus 100 further includes a sensor 6 which detects the leading edge of the medium S when the medium S is conveyed to a processing portion T. The surface processing apparatus 100 further includes registration rollers 5 which correct skew feed of the medium S fed from the conveying roller pair 4, and which correct the timing of conveying the medium S.

The surface processing apparatus 100 further includes a platen roller 7 which is a roller-type platen and serves as a supporting member, and a thermal head 8 which is a contact type local heating device and serves as a heating device. The platen roller 7 and the thermal head 8 are disposed opposite to each other across a conveying path of the medium S. The platen roller 7 functions as a bottom support when the thermal head 8 is pressed on the platen roller 7 via a film 11 mentioned later and the medium S, and conveys the medium S. The thermal head 8 selectively generates heat in accordance with information on processing regions mentioned later.

The surface processing apparatus 100 further includes the film 11 which is pressed against the medium S by the thermal head 8 and selectively heated, a take-up shaft 13 as take-up means for taking up the film 11, and a feed shaft 12 as feeding means for feeding the film 11. The take-up shaft 13 is driven to rotate by a take-up shaft driving motor M1 (FIG. 6) as a driving source. The take-up shaft driving motor M1 can drive the take-up shaft 13 to rotate in a direction in which the film 11 from the feed shaft 12 is taken up by the take-up shaft 13. At this moment, the feed shaft 12 can be rotated in a direction in which the film 11 is fed to the take-up shaft 13. In order to prevent the film 11 from slacking, biasing units for biasing the feed shaft 12 to rotate in a direction opposite to the above-mentioned direction may be provided on the feed shaft 12.

Here, a surface of the film 11 which is brought into contact with the medium S is defined as a front surface, and the opposite surface thereof is defined as a back surface. Moreover, a surface of the medium S which is brought into contact with the film 11 is defined as a front surface, and the opposite surface thereof which is brought into contact with the platen roller 7 is defined as a back surface.

The surface processing apparatus 100 further includes a first tension roller 34 and a second tension roller 35 which are disposed so as to be brought into contact with the back surface side of the film 11. The surface processing apparatus 100 includes a separating member 15, which is disposed so as to be brought into contact with the back surface side of the film 11, for separating the film 11, which has been heated and pressed by the thermal head 8, from the medium S. The feed shaft 12, the take-up shaft 13, the platen roller 7, and the first and second tension rollers 34 and 35 have rotational axes which are substantially parallel with the longitudinal direction of the separating member 15. The film 11 is pulled out from the feed shaft 12, wrapped around a part of the outer circumference of the first tension roller 34, and guided to the processing portion T which is a pressing portion (nip) configured by the thermal head 8 and the platen roller 7. Then, the film 11 passes through the processing portion T and the second tension roller 35, and is bent by the separating member 15, guided to the take-up shaft 13, then taken up by the take-up shaft 13. The conveying direction of this film 11 is defined as a forward direction. The conveying direction of the film 11 is substantially orthogonal to the rotational axes of the feed shaft 12, the take-up shaft 13, the platen roller 7, the first and second tension rollers 34 and 35, and the longitudinal direction of the separating member 15. When performing surface processing of the medium S, the conveying directions of the film 11 and the medium S at the processing portion T are the same. The first and second tension rollers 34 and 35 are rotatable guide rollers around which the film 11 is wrapped. The first and second tension rollers 34 and 35 are rotated in association with the conveyance of the film 11.

The surface processing apparatus 100 further includes a registration roller pair 5 being a pair of rollers which are pressed to each other. The registration roller pair 5 is disposed upstream of the processing portion T in the conveying direction of the medium S in order to adjust the attitude of the medium S before processing the medium S. The registration roller pair 5 is driven to rotate by a registration roller driving motor M2 (FIG. 6) as a driving source. The registration roller pair 5 conveys, after correcting the skew feed of the medium S, the medium S to the processing portion T. The skew feed of the medium S is corrected by bringing the leading edge of the medium S in the conveying direction into abutment with a contacting portion (nip) of the registration roller pair 5 of which rotation is stopped.

The surface processing apparatus 100 further includes, on an upstream side of the registration roller pair 5 in the conveying direction of the medium S, the conveying roller pair 4 being a pair of rollers which are pressed to each other. The surface processing apparatus 100 further includes, on a downstream side of the processing portion T in the conveying direction of the medium S, the conveying roller pair 9 being a pair of rollers which are pressed to each other. The conveying roller pair 4 conveys the medium S to the registration roller pair 5. The conveying roller pair 9 conveys the medium S after being processed to an external delivery tray 16 of the surface processing apparatus 100, which will be described later, or a place for post-processing steps.

Moreover, the surface processing apparatus 100 is provided with, on the downstream side of the registration roller pair 5 and on the upstream side of the first tension roller 34 in the conveying direction of the medium S, the medium sensor 6 which detects the presence or absence of the medium S. The medium sensor 6 can detect the medium S which is being conveyed.

As described in detail later, the film 11, the feed shaft 12, the take-up shaft 13, the first and second tension rollers 34 and 35, and the separating member 15 are contained in a film cartridge 14 so that they can be detachably mounted onto the apparatus main body 1 in an integrated manner.

The surface processing apparatus 100 further includes a delivery roller pair 10 which delivers outside the housing of the apparatus main body 1 the medium S to which the surface processing has been applied. The surface processing apparatus 100 includes the delivery tray 16 on which the media S, which have been delivered outside the apparatus main body 1, are stacked.

2. Configurations of Respective Parts of Surface Processing Apparatus

Next, respective parts of the surface processing apparatus 100 will be further described.

2-1. Thermal Head

Figure 3:
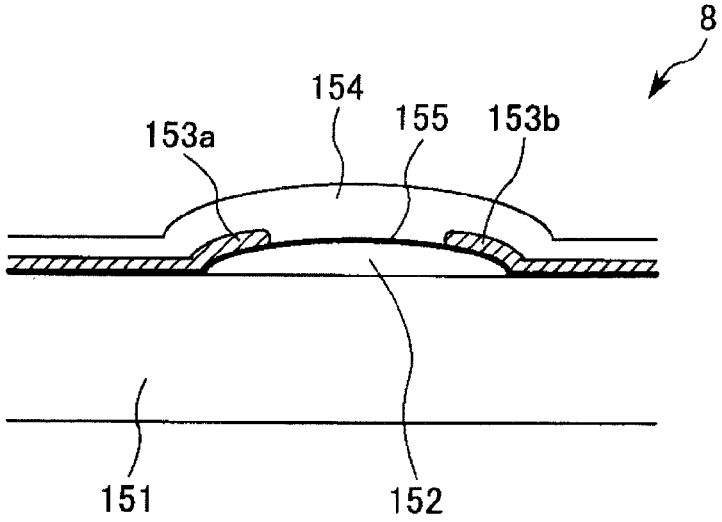
FIG. 3 is a schematic cross-sectional view illustrating an example of a configuration of the thermal head.

The basic configuration and specifications of the thermal head 8 will be described. FIG. 3 is, in particular, a schematic view of the configuration of a heat-generating element of the thermal head 8. The thermal head 8 is configured by forming a common electrode 153*a* and a lead (individual) electrode 153*b* on a glaze (heat-insulating layer) 152 printed on a substrate 151 made of alumina, and forming a heat-generating resistor 155 on lower surfaces of respective electrodes. A protective layer (over coat layer) 154 is formed on the upper surfaces of the substrate 151, the heat-insulating layer 152, respective electrodes 153*a*, 153*b*, and the heat-generating resistor 155. A driving circuit 160 (FIG. 6) which selectively applies electric power to the heat-generating element so as to generate heat is connected to the thermal head 8. Moreover, the thermal head 8 is provided with a member which dissipates excess heat from the medium S after being heated, such as a radiator plate. The thermal head 8 includes a plurality of heat-generating elements (heating portions) which are linearly arranged along the direction substantially orthogonal to the conveying direction of the medium S. The thermal head 8 can heat the surface of the medium S via the film 11 by selectively heating different regions thereof in the arrangement direction.

The thermal head 8 used in this embodiment has a heat-generating element density of 300 dpi, a recording density (processing density) of 300 dpi, a driving voltage of 30 V, and a heat-generating element average resistance of 5,000Ω. However, the configuration and specifications of the thermal head 8 are not limited to those of this embodiment.

Figure 2:
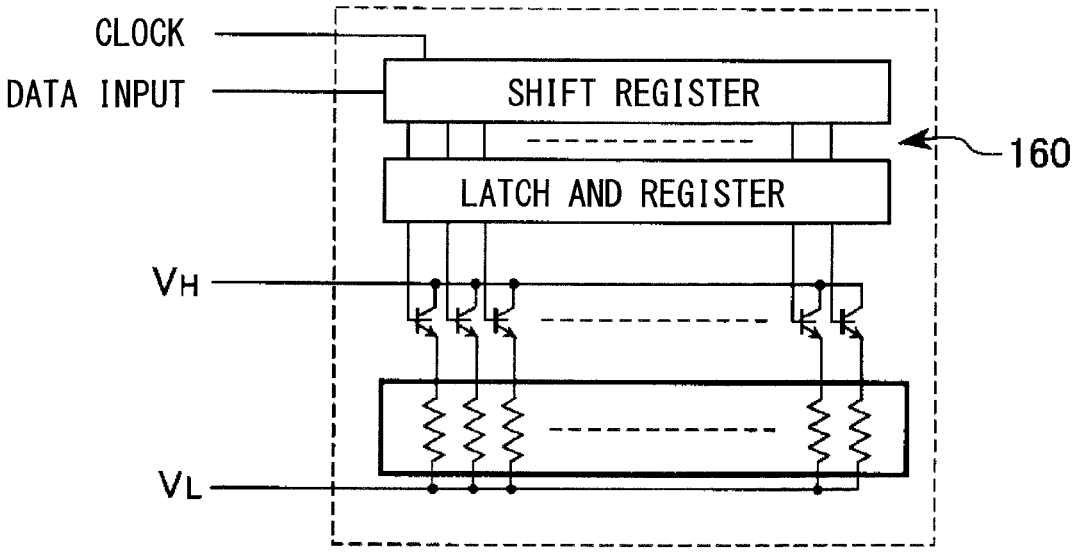
FIG. 2 is a circuit diagram illustrating an example of a driving circuit of a thermal head.

FIG. 2 is a schematic diagram of the driving circuit of the general thermal head 8. Heat-generating resistors forming a single line are provided on an alumina substrate, and electrodes are wired on both sides of each of the heat-generating resistors. There is provided, on the same alumina substrate or a separate circuit board, a driver IC including a group of registers which transfer and hold data of a single line (processing region information).

2-2. Platen Roller

The platen roller 7 is an elastic roller which is obtained by forming an elastic layer 7*b* made of a member having a high friction coefficient, such as hard rubber, into a roller shape around a shaft (core metal) 7*a*. In this embodiment, the platen roller 7 is a heat-resistant rubber roller which is obtained by forming the elastic layer 7*b* made of silicone rubber into a roller shape around the shaft 7*a*. The platen roller 7 is rotatably mounted onto the apparatus main body 1 via the shaft 7*a*. The platen roller 7 is driven to rotate via this shaft 7*a* by a platen roller driving motor M3 (FIG. 6) as a driving source so that the medium S and the film 11 are conveyed. In this embodiment, the conveying speed of the medium S is determined by the rotating speed of the platen roller 7, and the data (processing region information) to be transferred to the thermal head 8 is formed based on the rotating speed of the platen roller 7. In this embodiment, during surface processing, the medium S and the film 11 are conveyed at the processing portion T in the same direction at substantially the same speed.

2-3. Film

The film (transfer film) 11 is taken up on the feed shaft 12 by a desired length to be stored thereon, and is taken up, as necessary, by the take-up shaft 13 to be fed to the processing portion T. The film 11 is desirably made of a flexible thin material in order to locally heat the surface of the medium S. From this point of view, the thickness of the film 11 is desired to be equal to or less than 40 μm. Although, from the point of view of gloss processing, the thickness of the film 11 can be thinned to 2 μm, it is preferred to be equal to or more than 4 μm from the point of view of its strength. Moreover, in order to obtain excellent surface characteristics as to photo-like image clarity in surface processing, it is effective for the film 11 to have stiffness to some extent. For the materials mentioned below, the thickness is preferably equal to or more than 8 μm. As to the materials, a heat resistance against the thermal head 8 is required. Materials having a heat resistance of more than 200° C., such as polyimide, are desired. However, although a heating history remains, an inexpensive and general resin film (thermoplastic film), such as polyethylene terephthalate (PET), can be adopted. A release coating may be applied to a surface of the film 11 (i.e., the surface which is brought into contact with the medium S). This functional layer is a coating layer having low surface energy, which may be applied to enhance the mold releasability between the film 11 and the resin on the surface layer of the medium S. When the shape of the surface of the film 11 is transferred onto the surface of the medium S, a smooth releasing is desired in order to precisely transfer the shape of the film 11. As to the compositions for the functional layer, a fluororesin or a silicone resin, etc., may be used. As to the forming method, coating may be used, but the method is not limited to coating. The most important thing is to be able to form desired surface characteristics to be transferred. For example, in order to form a smooth surface of photography, such a smooth surface may be formed by coating a base film. The back surface of the film 11 (i.e., the surface sliding on the thermal head 8) may be provided with a sticking prevention layer. This layer may be provided in order to decrease mechanical friction with the thermal head 8. Because characteristics similar to those of the release coating mentioned above are required, concretely, coating by a fluororesin or a silicone resin similar to the release layer is effective. In this embodiment, the film 11 is formed by applying a release coating on a PET film (substrate) and providing a sticking prevention layer.

Because the film 11 transfers its surface shape (surface characteristics) on the medium S, when a smooth film of high gloss is used, a photo-like glossy surface of high gloss can be obtained by processing. Contrary to that, when a matte film made by sandblast or a film in a specific form is used, an inverted form of the form of the film can be transferred onto the medium S. For example, forms having various textures, which may be found in matte paper, Japanese paper, or embossed paper, can be transferred. Moreover, geometric patterns can be applied so that textures such as a grid pattern can be transferred. Further, a surface exhibiting a hologram color can be transferred by preparing geometric structures having an order of 1 μm or submicron. In this embodiment, the film 11 can be supplied as a part of the film cartridge 14 to be replaceable. In this embodiment, because the surface processing apparatus 100 can perform partial processing, a plurality of films 11 of types different from the above-mentioned film 11 can be provided to process only desired portions into various forms and hologram colors.

In this embodiment, the film 11 to be used has the size of about 320 mm to 350 mm in width in a direction substantially orthogonal to its conveying direction, and the thermal head 8 to be used also has an equivalent width in the same direction. Accordingly, the media S having various sizes up to A3 size can be treated. Moreover, in this embodiment, the film 11 is assumed to have a smooth surface to apply gloss on the medium S. In this embodiment, the film 11 is made of a thermoplastic film, which cannot be re-used because, once the film is used, wrinkles are generated at the heated portions due to its thinness.

2-4. Separating Portion

The portion (separating portion) of the processing apparatus, at which the medium S is separated from the film 11, will be described. For performing appropriate surface processing, the configurations of the thermal head 8 and the separating portion are important. In this embodiment, the separating member 15 plays two rolls including a cooling function of the film 11 and a function of separating the film 11 from the medium S due to its curvature. In this embodiment, the separating member is made of a metal, such as a SUS plate, and the curvature for separating is set to be sufficiently small (in this embodiment, the radius of curvature is 1 mm) so that the medium S can be surely released from the film 11.

The separating member 15 may be desirably provided with a cooling mechanism (not shown) which suppresses a rise of temperature at the separating portion. As to such a cooing mechanism, providing an air-cooling mechanism or attaching cooling fins is effective.

The temperature at the separating portion is monitored by thermistor resistors as temperature detecting units disposed at a plurality of positions. With this, the air capacity of the fan and the printing motions are controlled so as to keep the temperature equal to or less than a target cooling temperature T1° C. The target cooling temperature is desired to be set so as to correspond to Tg (glass-transition temperature) of the resin (thermoplastic resin) of the surface layer of the medium S, such as the colorant or overcoat member on the medium S. Taking into account the difference between Tg and the starting point of melting, the temperature is preferably set to be equal to or less than about (Tg+15)° C., more preferably equal to or less than Tg. The colorant layer may be a surface-layer material including components other than resin or colorant, such as wax. In this case, the temperature is preferably set equal to or less than the melting point of the wax. When the quality of the recording material cannot be specified, the temperature is preferably set to be sufficiently low around the room temperature. For example, the temperature is preferably set to 30 to 50° C.

2-5. Medium to be Processed (Cut Paper)

In this embodiment, as the medium S, a printed matter output by an electrophotographic image forming apparatus is used. Examples of the printed matter include a recording material on which an image is formed by a four-color process of CMYK, or a recording material on which an image is formed by a five-color process using a recorded image by four-color toner of CMYK and transparent toner mainly made of a colorant-free resin. As the transparent toner, for example, pigment-free toner mainly made of a polyester resin may be used. Moreover, as the transparent toner, particles which are made of a substantially colorant-free resin having high optical transparency can be preferably used. Such particles are substantially colorless, and enable at least visible light to well transmit through the particles substantially without scattering the visible light. Note that, transparent toner which becomes substantially colorless and transparent as mentioned above after being fixed can also be preferably used, and the toner is not required to be colorless and transparent before being fixed. For example, the toner may be observed as white color when the toner is aggregated. For example, as to the transparent toner, a printing pattern may be determined and output such that the transparent toner is added to portions of low coverage rate after being classified into CMYK so as to cover the overall recording material with the toner. With this, surface processing can be applied to arbitrary portions of the medium S. Moreover, a given amount of transparent toner may be applied on the overall surface of the recording material. For example, as to the gloss for the printed matter by the electrophotographic image forming apparatus, the fixing state of toner at the electrophotographic image forming apparatus may be adjusted so as to make the gloss about 10% at 60° gloss.

Further, for example, as the medium S, other than the four-color or five-color process mentioned above, there can be used a recording material on which an image is formed by a four-color process applied to a recording material on which a resin coating has been applied.

For example, a recording material recorded by thermofusible transfer recording, sublimation dye transfer recording, or ink-jet recording may be similarly used as the medium S. Also in this case, surface processing can be applied to arbitrary portions of the overall surface of the medium S by covering the surface of the recording material with a thermoplastic resin.

2-6. Conveying Roller

In this embodiment, the minimum size of the medium S is assumed to be equivalent to L-size of photograph, and hence the pitch between the rollers is set to be equal to or less than about 100 mm. Similarly, the distance between the platen roller 7 and the upstream or downstream conveying roller is about 100 mm.

2-7. Basic Motions in Surface Processing

Figure 6:
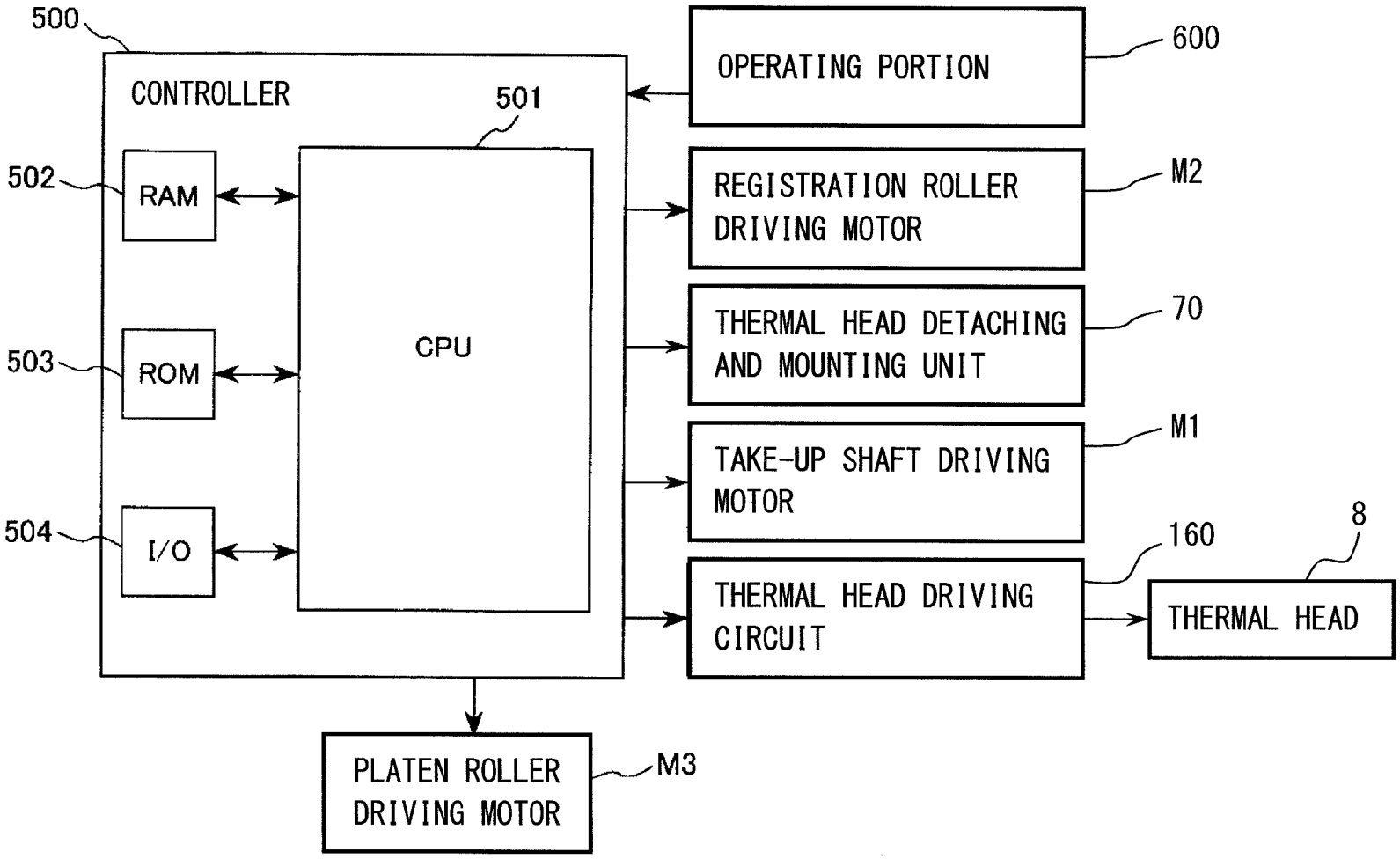
FIG. 6 is a block diagram illustrating a general control mode of the surface processing apparatus according to the embodiment.
Figure 7:
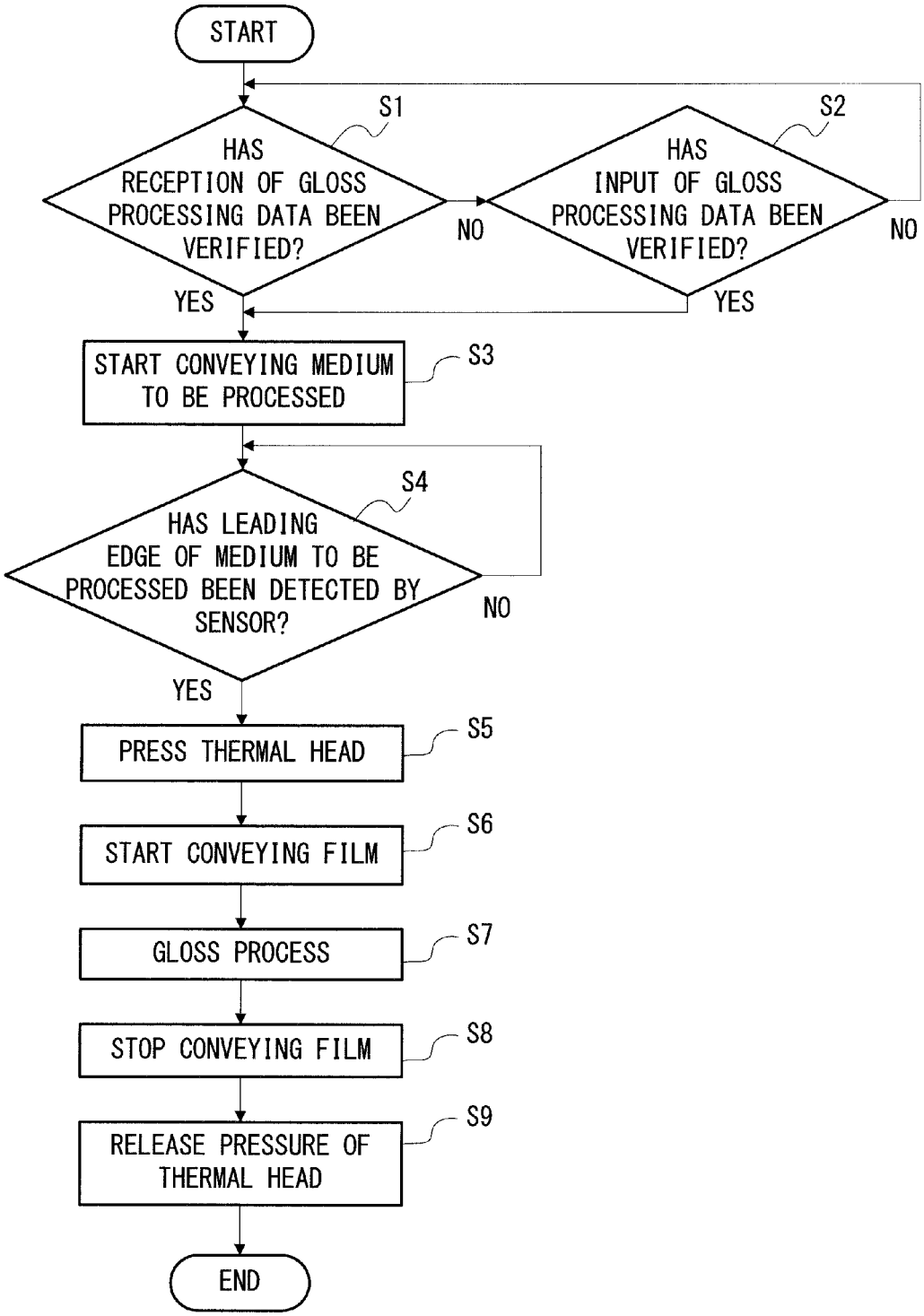
FIG. 7 is a flowchart of surface processing motions of the surface processing apparatus according to the embodiment.

FIG. 6 illustrates a schematic control mode of the surface processing apparatus 100 of this embodiment. FIG. 7 illustrates the procedure of basic motions in surface processing of the surface processing apparatus 100 of this embodiment.

The motions of the surface processing apparatus 100 are controlled by a controller (controlling portion) 500 as a controlling unit. Processing instructions (gloss processing instructions) are transmitted from a personal computer or an operating portion 600 to the controller 500, and a CPU 501 obtains the processing instructions. The CPU 501 controls the conveying operations by the conveying roller pairs 4, 9 and the registration roller pair 5, the operations of a detaching and mounting unit (described later) of the thermal head 8, the operations of the take-up shaft 13, the driving operations of the thermal head driving circuit 160, and the detecting operations of the medium sensor 6.

With reference to FIG. 7, first, the controller 500 verifies the reception of gloss processing data from the personal computer or other connected devices (USB flash drive, SD card) (S1) and the input of gloss processing data from the operating portion 600 (S2). The gloss processing data is made of data items of the size of recording paper to be applied with gloss processing, the pattern of the gloss processing, the processing regions, and an image data. The controller 500 will be further described later.

When the gloss processing data is received or input, the controller 500 starts conveying the medium S (S3). That is, the medium S made of a recording material P on which an image has been recorded is separately fed from the cassette 2 on which the media S are stacked by the feed roller 3 sheet by sheet into the apparatus main body 1, and the medium S is nipped and conveyed by the conveying roller pair 4. The medium S is conveyed up to the position of the registration roller pair 5 and temporarily stopped for skew feed correction.

After that, the registration roller pair 5 is driven to resume conveying of the medium S, and the leading edge of the medium S in the conveying direction is detected by the medium sensor 6 (S4). Then, the timing for driving the thermal head 8 is controlled in accordance with the timing when the medium S passes through the medium sensor 6.

Figure 4:
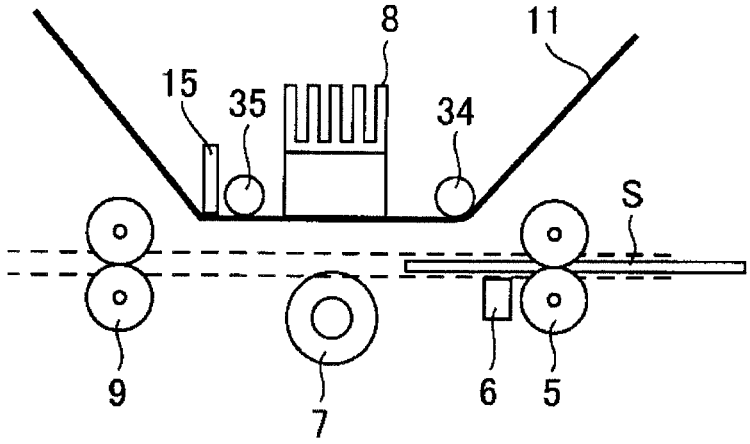
FIG. 4 is a schematic diagram illustrating abutting and separating motions of the thermal head.
Figure 5:
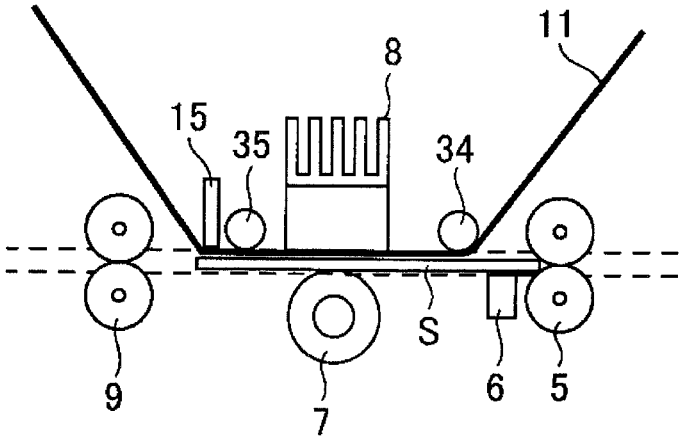
FIG. 5 is a schematic diagram illustrating the abutting and separating motions of the thermal head.

In this embodiment, as illustrated in FIG. 4, the thermal head 8 normally stands by in a state of being separated from the platen roller 7. When the controller 500 detects by the medium sensor 6 that the leading edge of the medium S has passed through the medium sensor 6, based on this timing, the controller 500 calculates the timing when the process starting point of the medium S is conveyed to the processing portion T. Then, in timed relation to the timing, the controller 500 controls the driving operations (pressing motions) of the thermal head detaching and mounting unit (described later) so that the thermal head 8 is moved as illustrated in FIG. 5 downward to be pressed against the platen roller 7 (S5). The controller 500 starts conveying the film 11 after the completion of pressing of the thermal head 8 (S6). That is, the take-up shaft 13 is stopped in the state illustrated in FIG. 4, and when the thermal head 8 is pressed against the platen roller 7 as illustrated in FIG. 5, the take-up shaft 13 is simultaneously driven.

At the processing portion T, the platen roller 7 opposes, across the conveying path of the medium S, the thermal head 8 which selectively generates heat in accordance with the processing region information. Then, the film 11 is conveyed under the thermal head 8, and the medium S is conveyed under the film 11. The film 11 is contained in the film cartridge 14, and is nipped by the thermal head 8 and the platen roller 7 together with the medium S so as to be conveyed. The controller 500 controls the heat-generating resistors of the thermal head 8 so as to selectively heat in accordance with a heating pattern determined by the processing region information described later. With this, the toner image on the medium S is re-used while the film 11 and the medium S are being nipped between the thermal head 8 and the platen roller 7 and conveyed. The separating member 15 is disposed downstream of the thermal head 8 in the conveying direction of the medium S so as to separate the film 11 from the medium S. At this time, because the medium S is sufficiently cooled, the toner image on the surface of the medium S can be solidified in a state in which the surface characteristics of the film 11 are transferred on the toner image, and thus desired gloss can be applied to the medium S (S7).

A driving device (take-up shaft driving motor M1) is connected to the take-up shaft 13 of the film 11 which is disposed in the film cartridge 14. Note that, the feed shaft 12 may be also provided with a driving device so as to prevent the film 11 from going slack by taking up the film 11 in the reverse direction. The take-up shaft 13 takes up the film 11 which is conveyed in association with the conveyance of the medium S, and simultaneously generates tension necessary for separating the film 11 from the medium S at the separating portion by the separating member 15. The tension necessary for separating the film 11 from the medium S is generated through setting of the take-up speed of the film 11 slightly faster than the conveying speed of the medium S and provision of a torque limiter to the driving device. As mentioned above, during gloss processing, the take-up shaft 13 takes up the film 11 which is conveyed in association with the conveyance of the medium S while generating the tension for separating the film 11 from the medium S.

After completion of the gloss processing, the controller 500 controls the take-up shaft 13 to stop its rotation (S8), and at substantially the same time, controls the thermal head 8 to separate (release pressure) from the platen roller 7, as illustrated in FIG. 4.

Finally, the medium S is guided to the delivery roller pair 10 and delivered outside the housing of the apparatus main body 1, and thus the operations of the surface processing are completed. Note that, in this embodiment, the moving speed of the medium S is controlled to be 100 mm/s during surface processing (recording).

The various motions of the surface processing apparatus 100 mentioned above are integrally controlled by the controller (controlling portion) 500. The controller 500 controls the motions of respective portions of the surface processing apparatus 100 based on the processing instructions transmitted from the personal computer and the processing instructions input by the operating portion 600 disposed in the surface processing apparatus 100. The controller 500 includes the CPU 501 as a controlling unit, and a ROM 503 and a RAM 502 as a storage unit. The CPU 501 performs controlling based on the programs and data stored in the ROM 503 and the RAM 502 in accordance with the processing instructions. The processing instructions include processing region information for causing the thermal head 8 to selectively generate heat in synchronization with the timing when a corresponding region of the medium S passes through the processing portion T. The thermal head 8 generates heat correspondingly to a given position of the medium S based on its processing region information to perform surface processing of the medium S. When a processing instruction is transmitted to the controller 500, the controller 500 transmits an instruction to a conveying unit to start conveying the medium S. At the same time, the controller 500 also transmits the processing region information (gloss image data) to the thermal head driving circuit 160. When a given time period has elapsed after the medium S passed through the medium sensor 6, an instruction is transmitted to the thermal head detaching and mounting unit 70 so as to press the thermal head 8 against the platen roller 7. The thermal head 8 performs the surface processing (gloss processing) to a given position of the medium S based on the processing region information. Moreover, after the medium S passes through the separating portion of the separating member 15, the controller 500 transmits an instruction to the thermal head detaching and mounting unit 70 so as to separate the thermal head 8 from the platen roller 7.

Here, as mentioned above, because the film 11 is conveyed together with the medium S, the conveying distance of the film 11 is the same as that of the medium S. As mentioned above, in this embodiment, as the material for the film 11, a PET film, which is a very thin thermoplastic resin film, is used. This is because, if the film is thick, the amount of electric power supplied to the thermal head 8 becomes large for selectively re-fusing the toner on the medium S by the thermal head 8. Further, edge portions can be prevented from being blurred when being heated. When using the thin film, the necessary amount of electric power can be decreased and image sharpness can be obtained, but, on the other hand, the film cannot be re-used because the thin film is thermally deformed.

Note that, in this embodiment, as the medium S, a printed matter printed by an electrophotographic system is used, and in such a printed matter, margins are usually provided at the leading edge portion and the trailing edge portion of the recording material, such as recording paper. Because no toner image is formed on these margins, the surface processing apparatus 100 of this embodiment cannot perform gloss processing on the margins. Although the surface processing apparatus 100 of this embodiment can perform partial gloss processing, there may be a region having no image data at all in the paper width direction depending on an image data for gloss processing. The pitch between the platen roller 7 and each of the registration roller pair 5 and the conveying roller pair 9 is set to about 100 mm. Therefore, when the gloss processing is performed to the medium S which is equal to or less than 200 mm, such as a postcard, the thermal head 8 needs to be pressed against the platen roller 7 in order to convey the medium S.

3. Film Cartridge

Next, the configuration of the film cartridge 14 will be described in detail.

Figure 8:
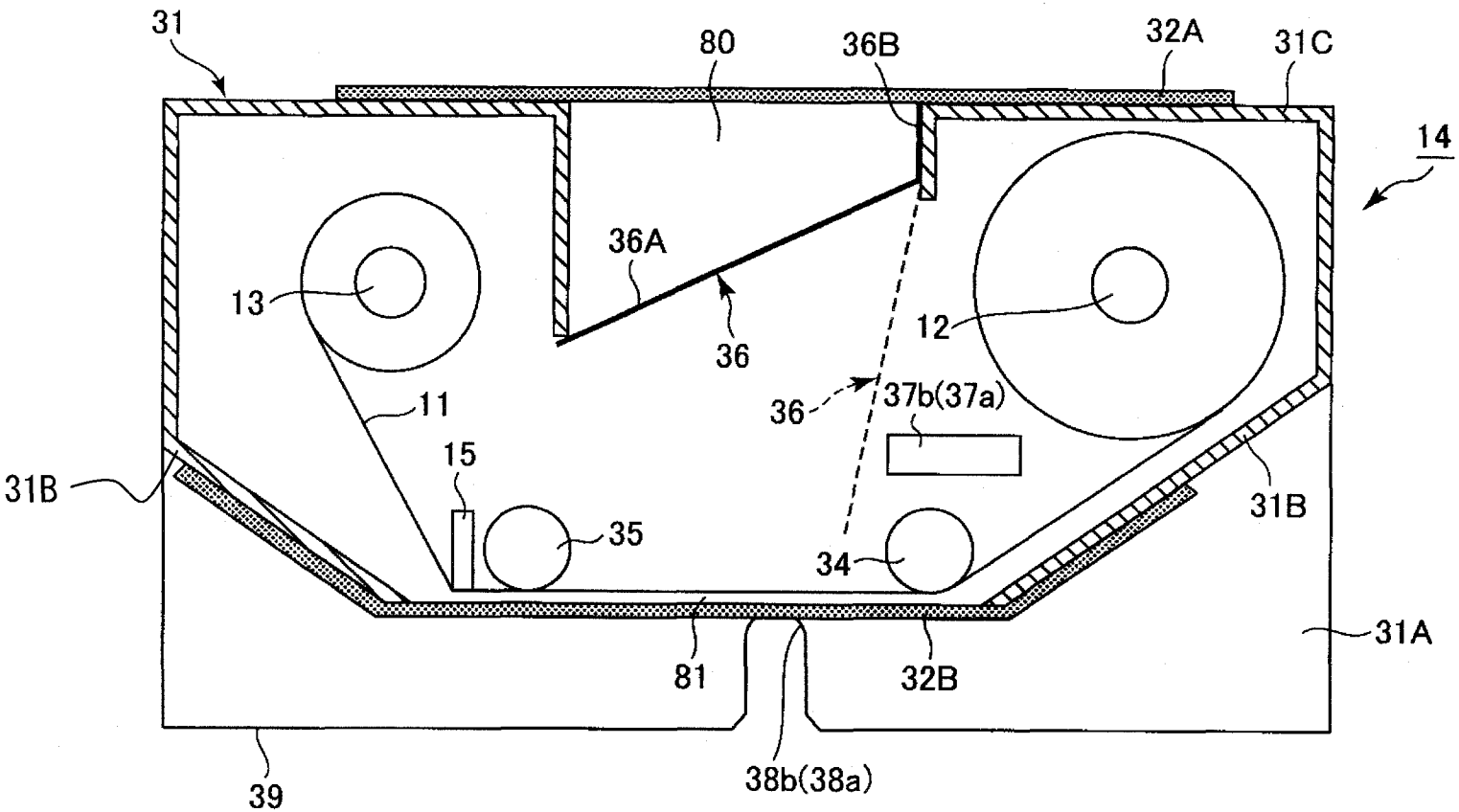
FIG. 8 is a schematic cross-sectional view of a film cartridge according to the embodiment before mounting.
Figure 9:
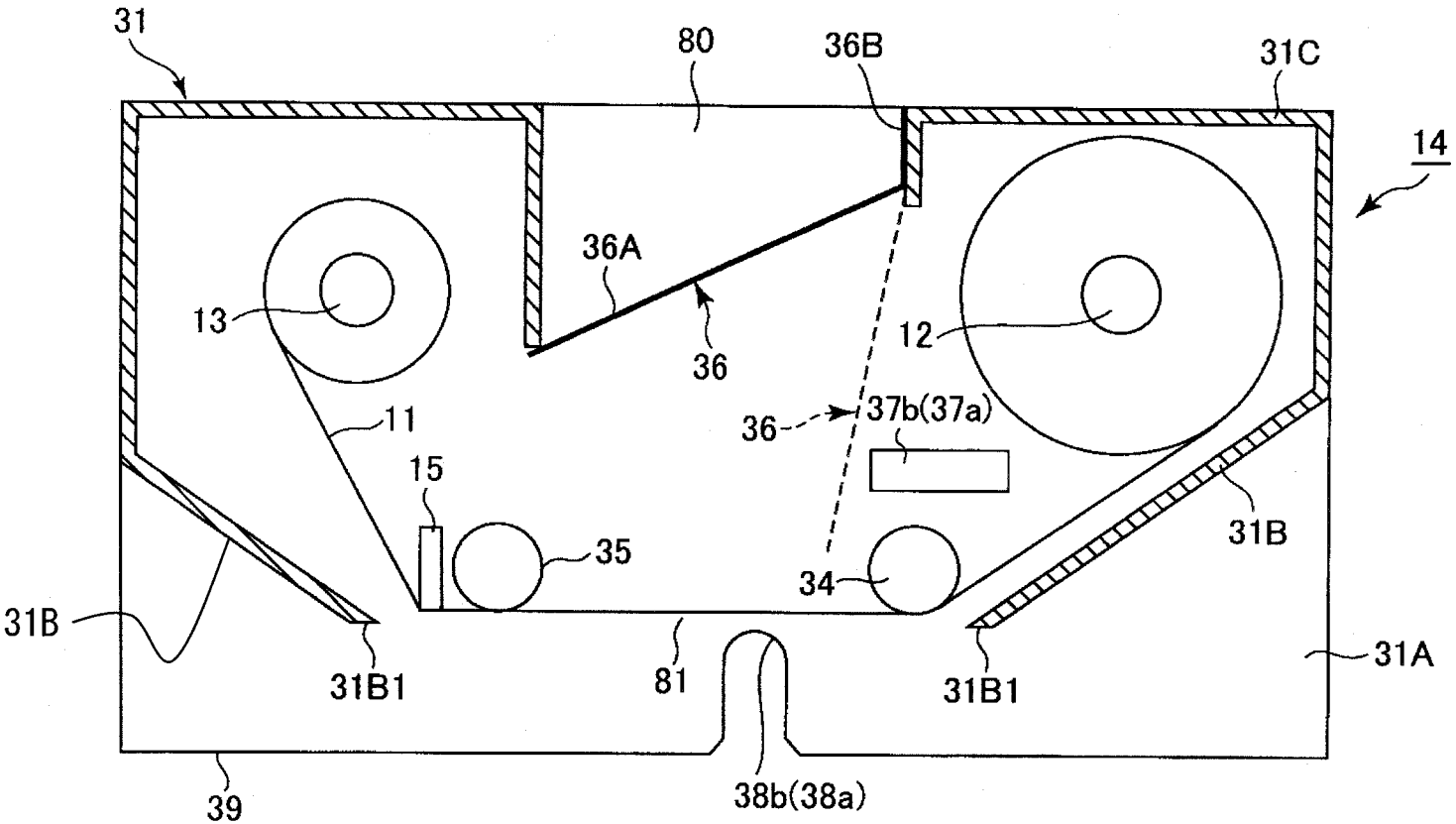
FIG. 9 is a schematic cross-sectional view of the film cartridge according to the embodiment at the time of mounting.
Figure 10:
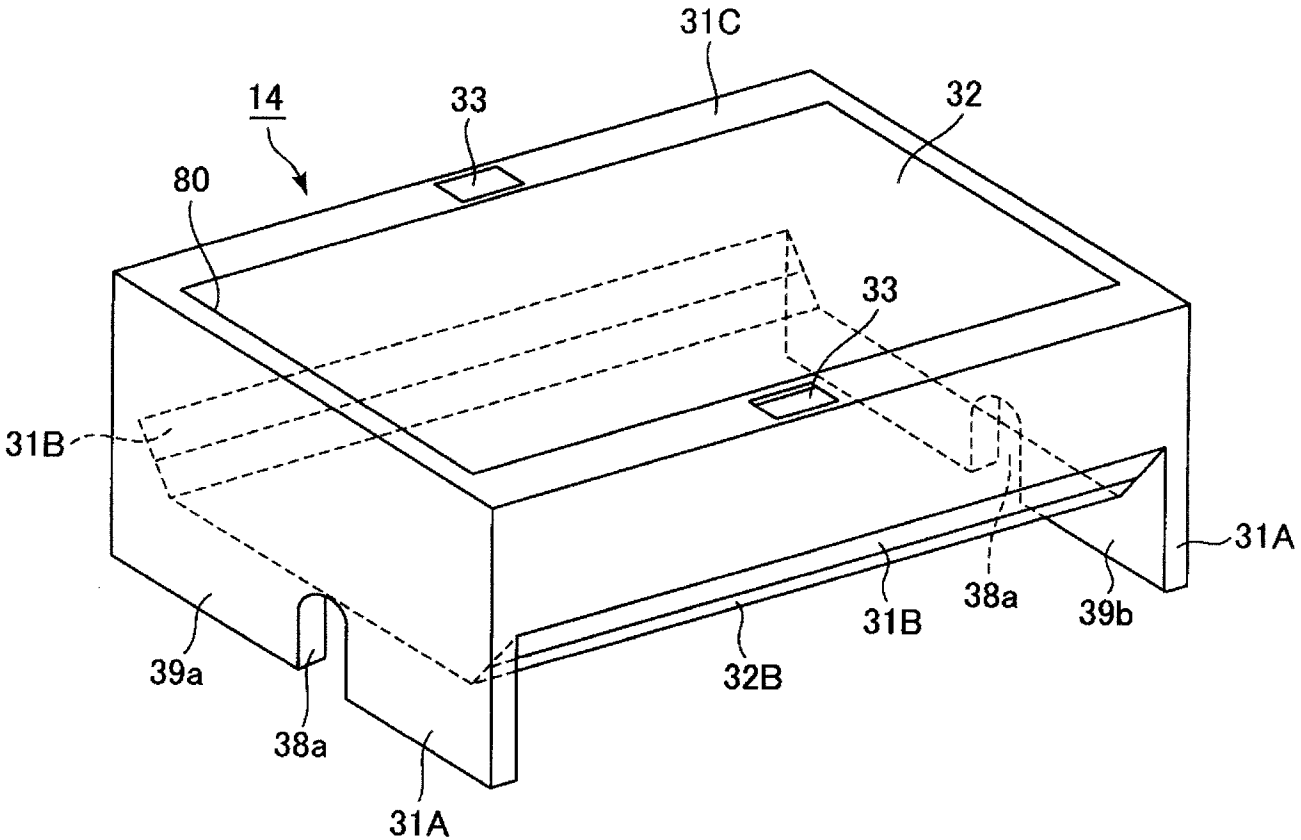
FIG. 10 is a schematic perspective view of the film cartridge with some elements thereof being omitted.

FIGS. 8 and 9 are schematic cross-sectional views of the film cartridge 14. FIG. 8 illustrates a state before the film cartridge 14 is mounted on the apparatus main body 1 of the surface processing apparatus 100, and FIG. 9 illustrates a state when the film cartridge 14 is to be mounted thereon. FIG. 10 is a schematic perspective view of the film cartridge 14 with some elements being omitted.

For convenience, in the following descriptions about the film cartridge 14, the front surface side of the sheet of FIG. 1 is defined as the left side, and the back surface side of the sheet is defined as the right side, under the state in which the film cartridge 14 is mounted on the apparatus main body 1 of the surface processing apparatus 100. Similarly, the right side of the sheet of FIG. 1 is defined as the feeing side, and the left side thereof is defined as the delivery side. Similarly, the upper side of the sheet of FIG. 1 is defined as the upper side, and the lower side thereof is defined as the lower side.

The film cartridge 14 includes a casing (housing) 31. The casing 31, in general, includes left and right side surfaces 31A, feeding and delivery side surfaces 31B, and an upper surface 31C. As described later in detail, the upper surface 31C of the casing 31 is provided with a first opening portion 80 into which the thermal head 8 proceeds by a thermal head unit (heating unit) 50. A second opening portion 81, which is defined by edge portions 31B1 of the feeding and delivery side surfaces 31B and the left and right side surfaces 31A, is provided at the lower side of the casing 31. The second opening portion 81 enables the thermal head 8 to oppose to (and abut via film 11 during processing against) the platen roller 7.

As illustrated in FIG. 8, the first opening portion 80 and the second opening portion 81 are sealed with a first seal 32A and a second seal 32B, respectively. As illustrated in FIG. 9, the first seal 32A and the second seal 32B can be removed when the film cartridge 14 is mounted onto the apparatus main body 1 of the surface processing apparatus 100. The first and second seals 32A and 32B may be made of suitable resin films, and are removably fixed by suitable fixing means, e.g., gluing or welding, so that an operator can peel the seals at the time of mounting.

In the casing 31, the film 11 is tensioned by being wrapped around the take-up shaft 13, the feed shaft 12, the first tension roller 34, and the second tension roller 35. The separating member 15 is disposed on the back side (inner side) of the film 11. The take-up shaft 13, the feed shaft 12, the first tension roller 34, and the second tension roller 35 are rotatably supported by the left and right side surfaces 31A of the casing 31. The separating member 15 is fixed between the left and right side surfaces 31A.

A flexible sheet 36, which is a sheet member having flexibility as a shield member, is attached between the first opening portion 80 and the back surface of the film 11. In this embodiment, a fixed portion 36B forming a part of the feeding-side edge portion of the flexible sheet 36 is adhered and fixed on the feeding-side edge portion of the first opening portion 80 which is formed by the upper surface 31C of the casing 31. In the natural state (i.e., a state where no external force is applied) of the flexible sheet 36, the delivery-side end portion of the flexible sheet 36 abuts the delivery-side edge portion of the first opening portion 80, and a planar shield portion 36A substantially completely closes the first opening portion 80. Accordingly, when the film cartridge 14 is mounted onto the apparatus main body 1, no dust or the like falls directly on the surface of the film 11 through the first opening portion 80. As described later, when the thermal head unit 50 proceeds into the film cartridge 14 through the first opening portion 80, the flexible sheet 36 is pressed by the thermal head unit 50 so as to open into the inside of the film cartridge 14, thereby opening the first opening portion 80.

As mentioned above, in this embodiment, the film cartridge 14 includes the first seal 32A removably attached to the casing 31, for sealing the first opening portion 80. The film cartridge 14 also includes the second seal 32B removably attached to the casing 31, for sealing the second opening portion 81. Moreover, the film cartridge 14 includes the sheet member 36 attached to the inside of the first opening portion 80 of the casing 31 so as to cover the surface of the film 11.

Inside the respective left and right side surfaces 31A of the casing 31, there are formed opening and closing operational portions 37 (37*a*, 37*b*) whish act on an opening and closing mechanism for a shutter 55 (described later) to open and close the shutter 55 for the thermal head 8.

Figure 11:
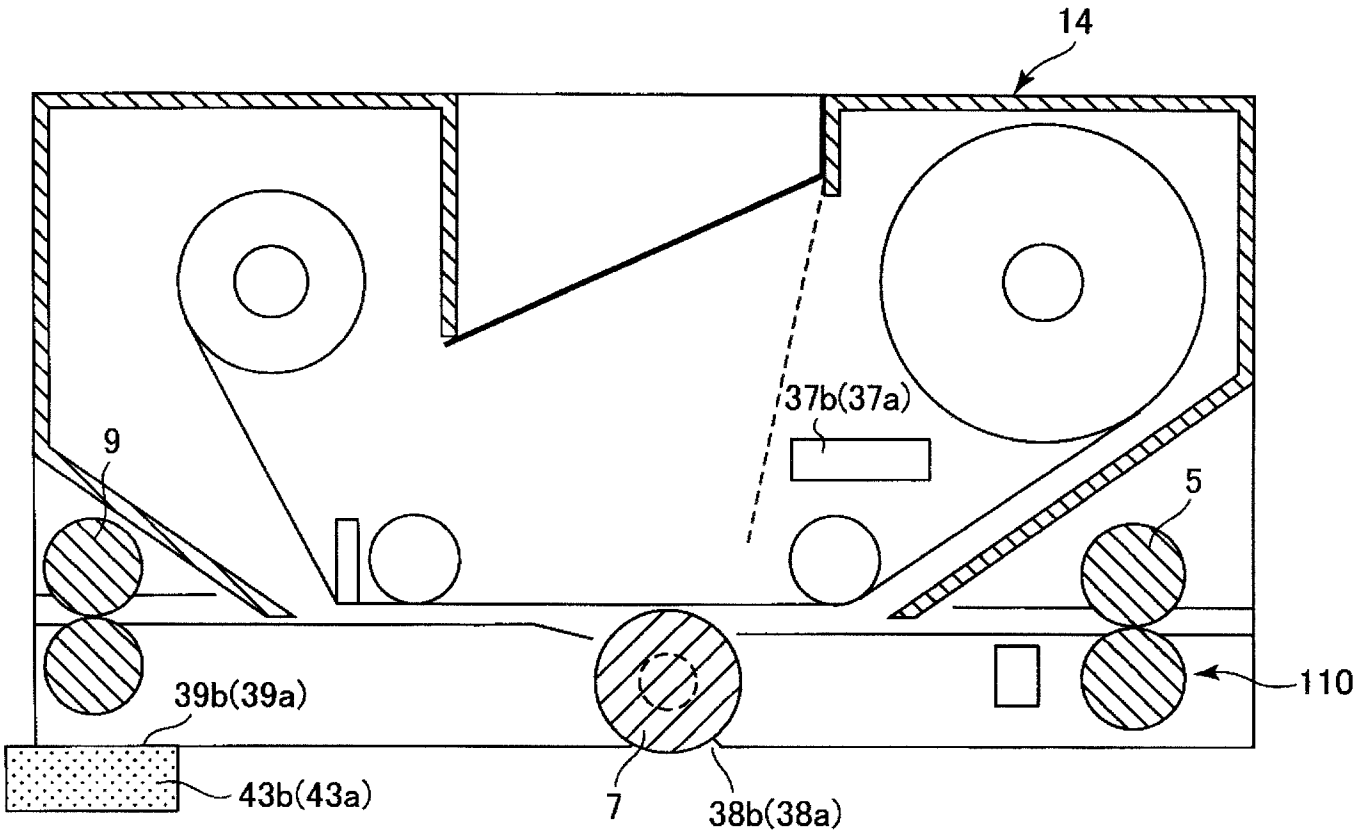
FIG. 11 is a schematic cross-sectional view illustrating a state in which the film cartridge is set in a conveying unit provided in a main body of the surface processing apparatus.
Figure 12:
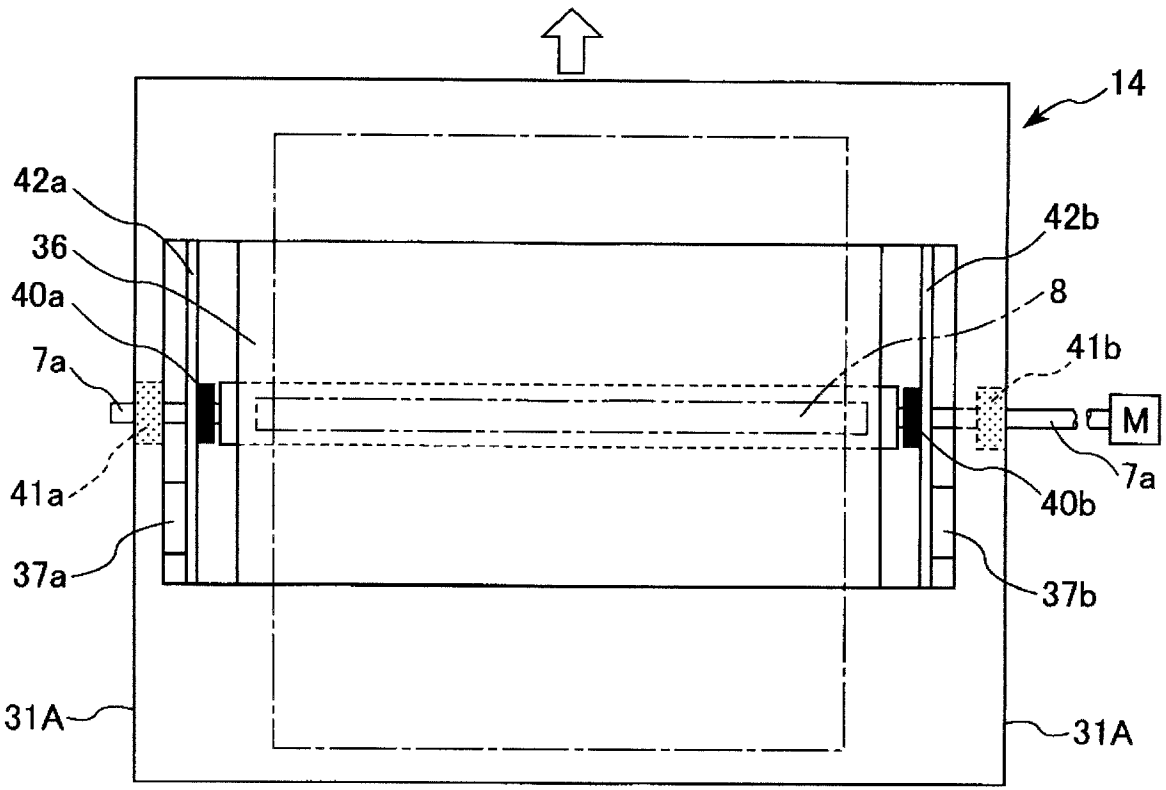
FIG. 12 is a top view illustrating a state in which the film cartridge is set in the conveying unit provided in the main body of the surface processing apparatus.

FIG. 11 is a schematic cross-sectional view illustrating a state in which the film cartridge 14 is set on a conveying unit 110 (including the platen roller 7, the registration roller pair 5, and the conveying roller pair 9) provided in the apparatus main body 1 of the surface processing apparatus 100. FIG. 12 is a top view of the same state.

As illustrated in FIGS. 11 and 12, the left and right side surfaces 31A of the housing 31 of the film cartridge 14 are fitted onto frames 42 (42*a*, 42*b*) of the conveying unit 110, respectively, from the outside. In addition, positioning portions 38 (38*a*, 38*b*) respectively formed on the left and right side surfaces 31A of the housing 31 are fitted onto bearings 41 (41*a*, 41*b*) attached to the shaft 7*a* of the platen roller 7. In addition, in this embodiment, the edge portions of the left and right side surfaces 31A of the housing 31 near the delivery-side end portions of the housing 31 function as additional positioning portions 39 (39*a*, 39*b*), respectively. These additional positioning portions 39 (39*a*, 39*b*) are rested on receiving portions 43 (43*a*, 43*b*) which are disposed on the conveying unit 110, respectively. In this manner, the film cartridge 14 is to be positioned with respect to the apparatus main body 1.

4. Thermal Head Unit

Figure 13:
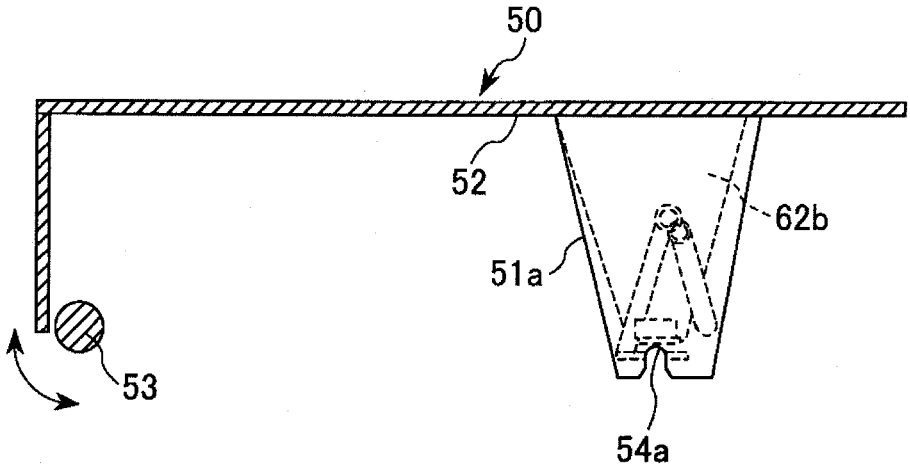
FIG. 13 is a left side view of a thermal head unit with some elements thereof being omitted.
Figure 14:
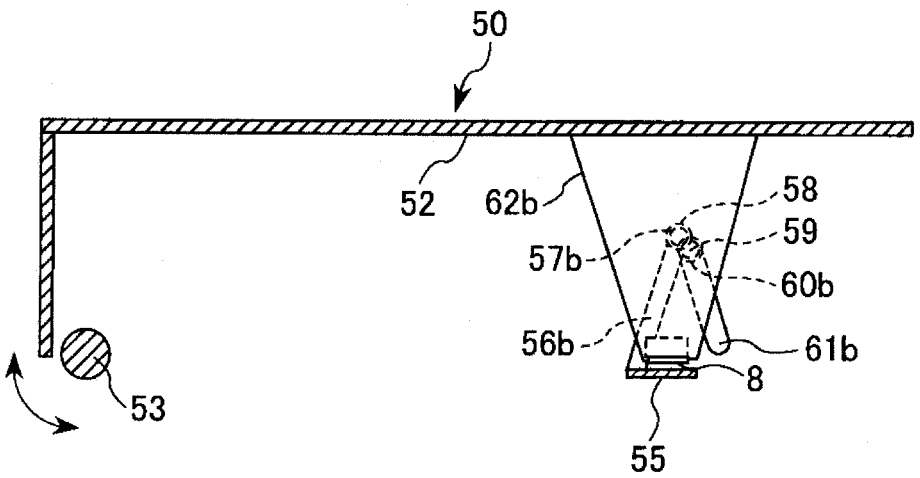
FIG. 14 is a cross-sectional view of the thermal head unit cut near the central portion in a left-right direction thereof with some elements thereof being omitted.
Figure 15:
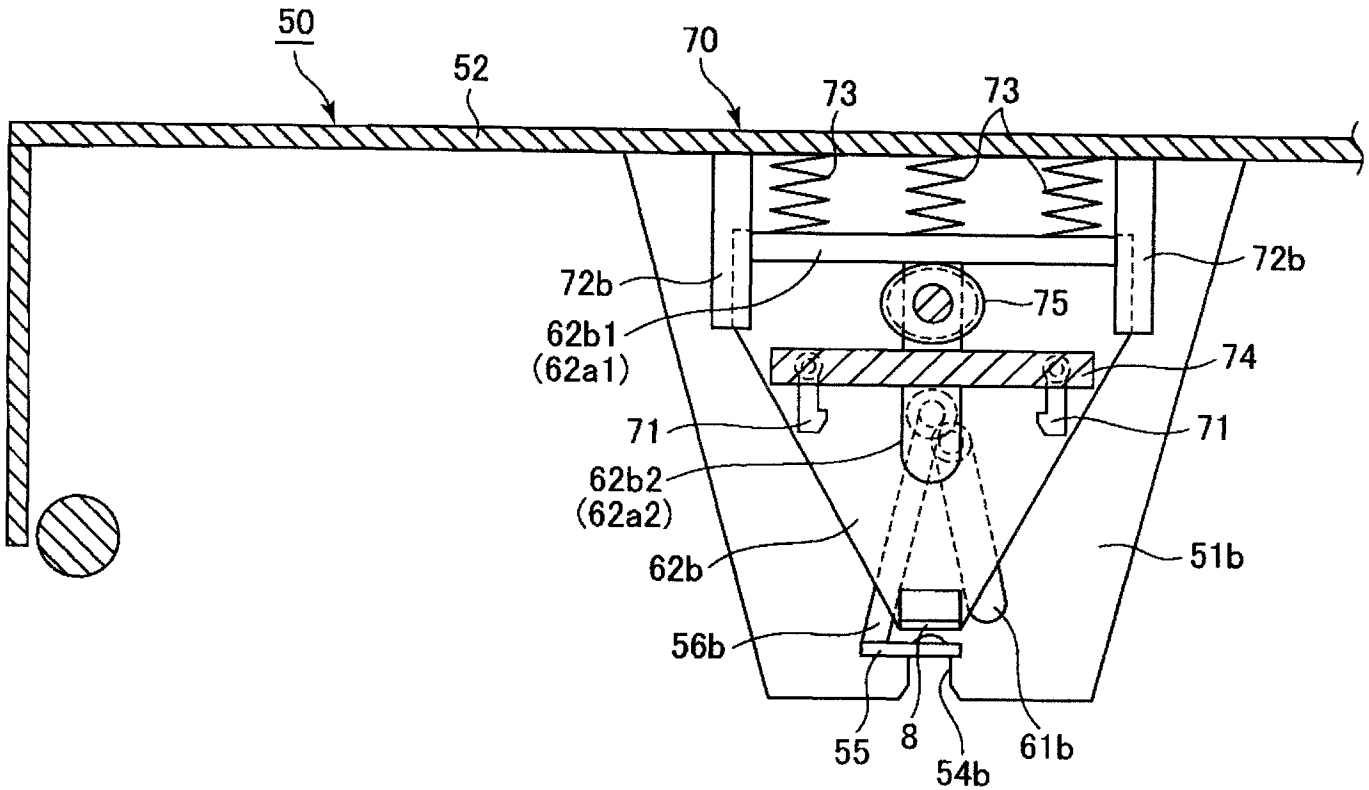
FIG. 15 is a cross-sectional view illustrating in more detail a portion of the thermal head unit cut near the central portion in the left-right direction.
Figure 16:
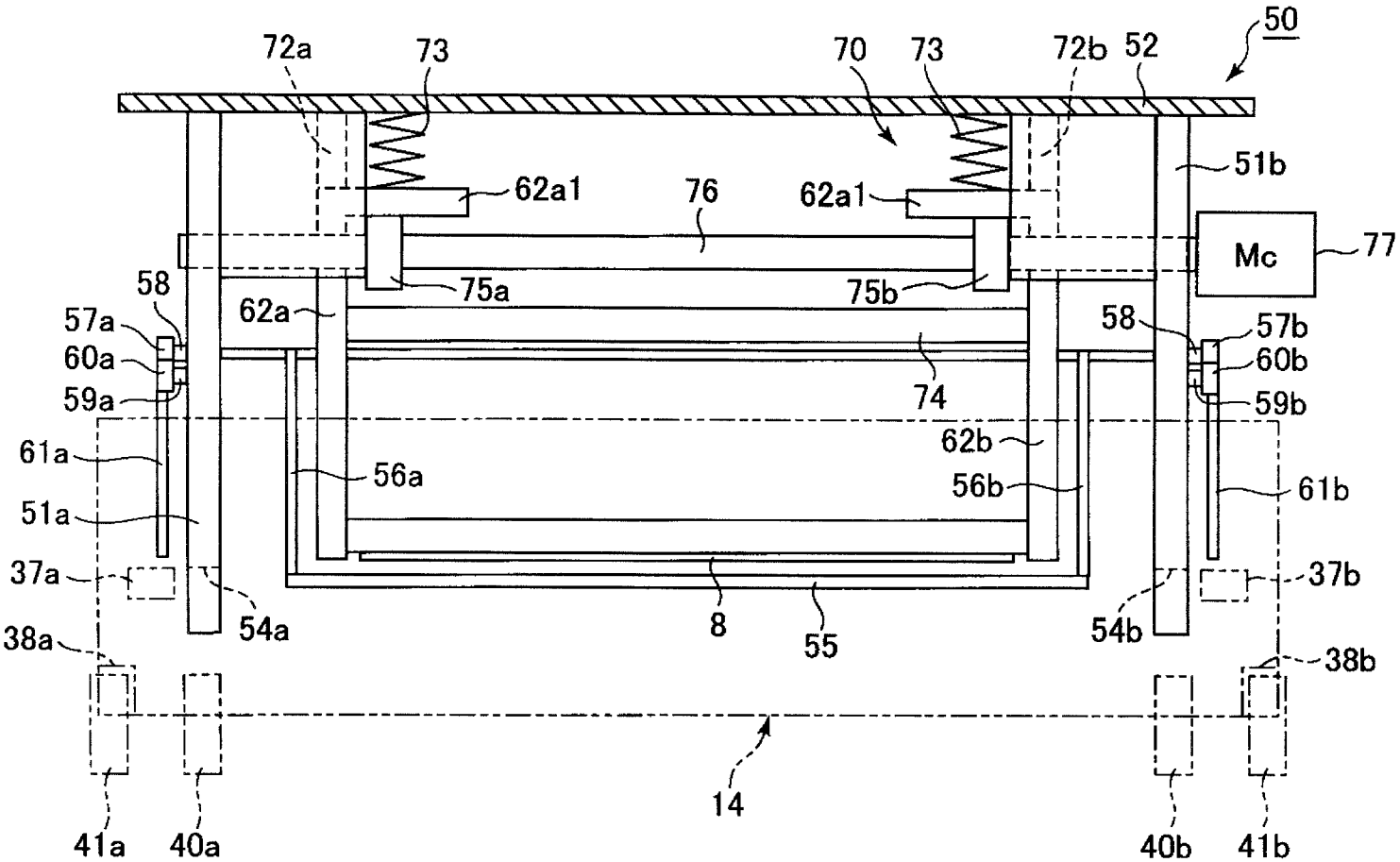
FIG. 16 is a partial cross-sectional side view of the thermal head unit viewed from a feeding side.

Next, the thermal head unit 50 will be described. FIG. 13 is a side view of the thermal head unit 50 viewed from the left side with some elements thereof being omitted. FIG. 14 is a cross-sectional view of the thermal head unit 50 cut near the central portion thereof in the left-right direction with some elements thereof being omitted. FIG. 15 is a cross-sectional view illustrating in detail a part of the thermal head unit 50 cut near the central portion thereof in the left-right direction. FIG. 16 is a partial cross-sectional side view of the thermal head unit 50 viewed from the feeding side.

As illustrated in FIG. 13, the thermal head unit 50 includes a frame 52 which is rotatably supported about a rotational shaft 53. The rotational shaft 53 is rotatably supported on the apparatus main body 1 of the surface processing apparatus 100. The frame 52 supports left and right positioning holders 51 (51*a*, 51*b*) for positioning the thermal head unit 50 in an enabled state. The left and right positioning holders 51 (51*a*, 51*b*) are fitted onto the frames 42 (42*a*, 42*b*) (FIG. 12) of the conveying unit 110, respectively, from the inside. In addition, unit positioning portions 54 (54*a*, 54*b*), which are fitted onto bearings 40 (40*a*, 40*b*) attached to the shaft 7*a* of the platen roller 7, are formed in the left and right positioning holders 51 (51*a*, 51*b*), respectively. With this, as described later, when the thermal head unit 50 proceeds into the film cartridge 14 to become the enabled state, the thermal head 8 is positioned with respect to the platen roller 7.

As illustrated in FIG. 14, the thermal head unit 50 includes left and right thermal head holders 62 (62*a*, 62*b*) which are attached to the left and right positioning holders 51 (51*a*, 51*b*), respectively. The thermal head 8 is fixed between the left and right thermal head holders 62 (62*a*, 62*b*). The thermal head unit 50 includes a shutter shaft 58 which is rotatably disposed between the left and right positioning holders 51 (51*a*, 51*b*). This shutter shaft 58 is provided with left and right shutter holders 56 (56*a*, 56*b*) which are rotatably mounted onto the positioning holders 51 (51*a*, 51*b*) via the shutter shaft 58. The left and right shutter holders 56 (56*a*, 56*b*) are attached to the shutter shaft 58 between the positioning holders 51 (51*a*, 51*b*) and the thermal head holders 62 (62*a*, 62*b*), respectively. The shutter 55 for covering the surface of the thermal head 8 is disposed between the left and right shutter holders 56 (56*a*, 56*b*).

At both left and right end portions of the shutter shaft 58, shutter shaft gears 57 (57*a*, 57*b*) as driving force receiving units are fixed about the shutter shaft 58, respectively. Driving gears 60 (60*a*, 60*b*) as driving force transmitting units mesh with the left and right shutter shaft gears 57 (57*a*, 57*b*), respectively. The left and right driving gears 60 (60*a*, 60*b*) are fixed to driving shafts 59 (59*a*, 59*b*) and about the driving shafts 59 (59*a*, 59*b*) which are rotatably disposed to the left and right positioning holders 51 (51*a*, 51*b*), respectively. Shutter levers 61 (61*a*, 61*b*) are fixed to the left and right driving gears 60 (60*a*, 60*b*), respectively. Accordingly, the driving gears 60 (60*a*, 60*b*) rotate in association with the rotations of these shutter levers 61 (61*a*, 61*b*). The rotations of these driving gears 60 (60*a*, 60*b*) cause the rotations of the shutter shaft gears 57 (57*a*, 57*b*) so that the shutter shaft 58 rotates to rotate the shutter 55.

Here, in this embodiment, the thermal head 8 can abut and separate from the platen roller 7. Therefore, as illustrated in FIGS. 15 and 16 in more detail, the left and right thermal head holders 62 (62*a*, 62*b*) are attached to the positioning holders 51 (51*a*, 51*b*) via guides 72 (72*a*, 72*b*) so as to be slidable upward and downward, respectively. These left and right guides 72 (72*a*, 72*b*) are fixed to the left and right positioning holders 51 (51*a*, 51*b*), respectively. In more detail, the left and right thermal head holders 62 (62*a*, 62*b*) are biased downward by compression springs 73 as biasing units, which are disposed between the frame 52 and upper surfaces of convex portions 62*a*1, 62*b*1 formed at upper end portions of the left and right thermal head holders 62 (62*a*, 62*b*). Left and right cams 75 (75*a*, 75*b*) abut lower surfaces of the convex portions 62*a*1, 62*b*1. The left and right cams 75 are fixed to a switching shaft 76 which is rotatably disposed on the left and right positioning holders 51 (51*a*, 51*b*). The left and right thermal head holders 62 (62*a*, 62*b*) are connected via a connecting stay 74 to each other. When the cams 75 (75*a*, 75*b*) are rotated by a cam motor (Mc) 77 as a driving source connected to the switching shaft 76, the left and right thermal head holders 62 (62*a*, 62*b*) are moved upward and downward in the same phase. Accordingly, the thermal head 8 can be abutted and separated from the platen roller 7. In this embodiment, the thermal head detaching and mounting unit 70 is constituted by the guides 72 (72*a*, 72*b*), the compression springs 73, the cams 75 (75*a*, 75*b*), the switching shaft 76, and the cam motor 77. Note that, in this embodiment, as illustrated in FIG. 15, the left and right thermal head holders 62 (62*a*, 62*b*) are provided with through holes 62*a*2, 62*b*2 for movements of the switching shaft 76 and the shutter shaft 58 when the thermal head holders 62 (62*a*, 62*b*) move upward and downward.

Figure 17:
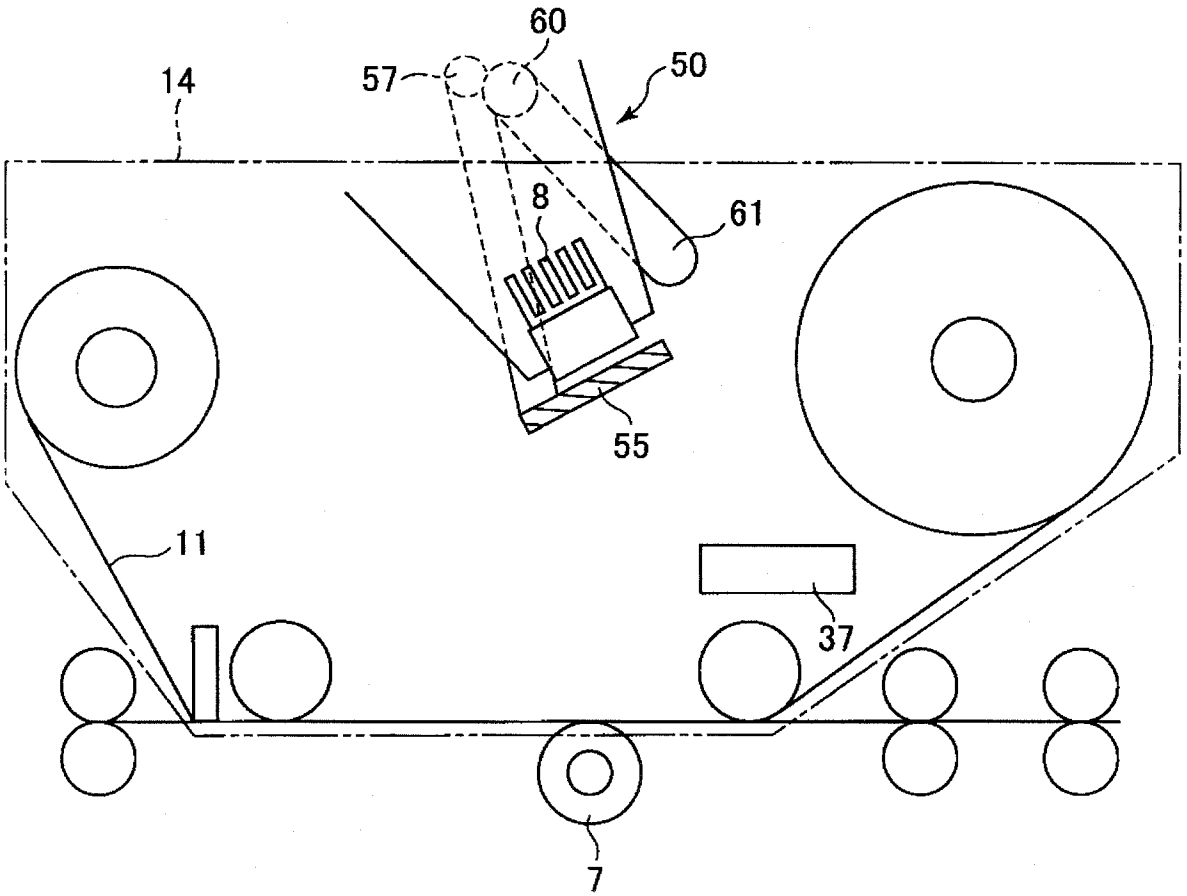
FIG. 17 is a schematic cross-sectional view illustrating a position of a shutter during a mounting process of the thermal head unit.
Figure 18:
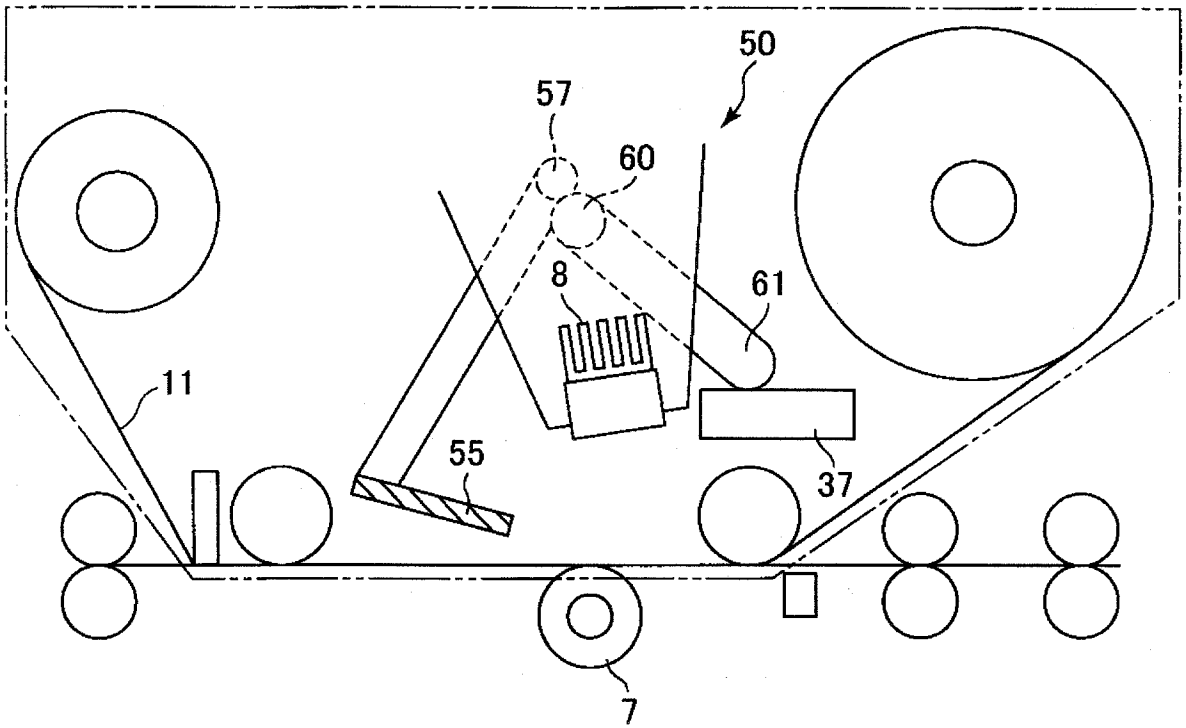
FIG. 18 is a schematic cross-sectional view illustrating a position of the shutter during the mounting process of the thermal head unit.
Figure 19:
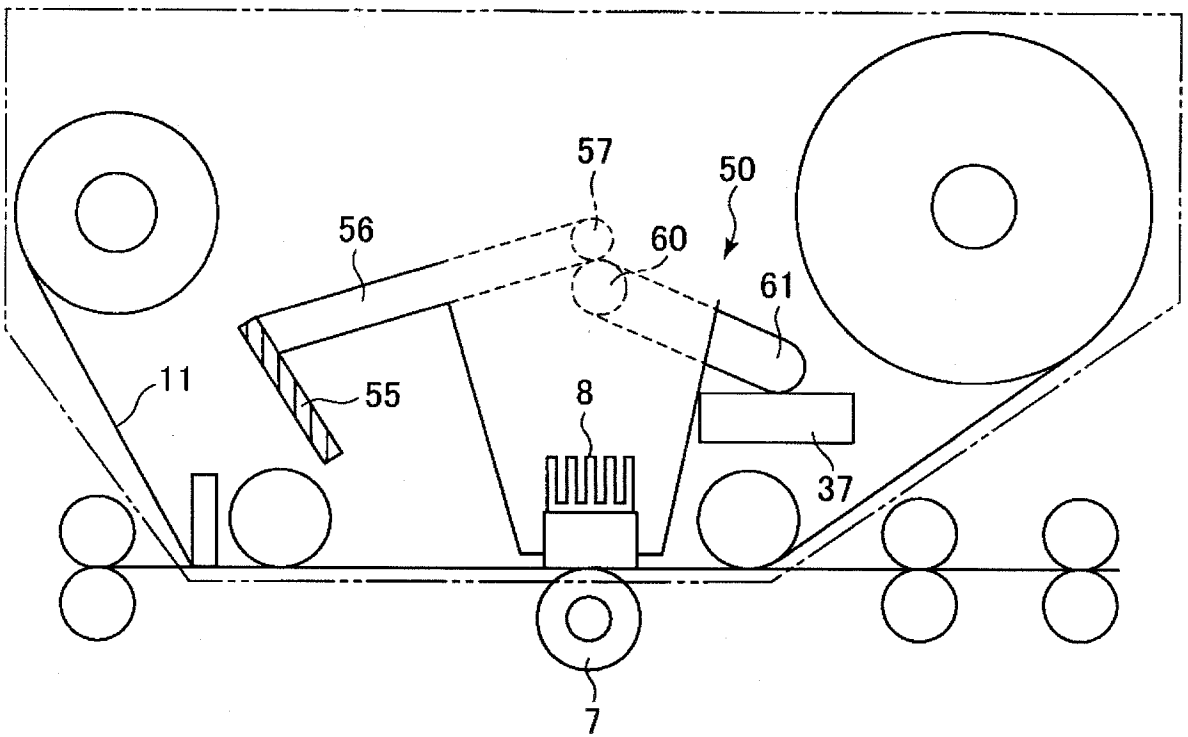
FIG. 19 is a schematic cross-sectional view illustrating a position of the shutter when the thermal head is located at its mounting position.

Next, the opening and closing motions of the thermal head shutter 55 will be described. FIGS. 17, 18 and 19 illustrate positions of the shutter 55 during the mounting process of the thermal head unit 50.

As illustrated in FIG. 17, the thermal head unit 50 is configured to proceed into the first opening portion 80 (FIGS. 9 to 12) with the shutter 55 being closed, while rotating about the rotational shaft 53.

In this state, the thermal head unit 50 is rotated to a position near the positioning portion with respect to the platen roller 7 by the positioning holders (51*a*, 51*b*). Then, as illustrated in FIG. 18, the shutter levers 61 (61*a*, 61*b*) rotate while being in contact with the opening and closing operational portions 37 (37*a*, 37*b*) so that the shutter 55 is opened. As illustrated in FIG. 19, the mounting operation of the thermal head unit 50 is completed at the position where the positioning by the positioning holders 51 (51*a*, 51*b*) with respect to the platen roller 7 is completed.

Here, in this embodiment, when the thermal head unit 50 is rotated to the position where the positioning by the positioning holders 51 (51*a*, 51*b*) with respect to the platen roller 7 is completed, the following state is caused. That is, locking hooks 71 for fixing the film cartridge, as locking units attached to the connecting stay 74 mentioned above (FIG. 15) engage locking holes 33 (FIG. 10) formed in the upper surface 31C of the housing 31 of the film cartridge 14 as locking receiving units. With this, when the left and right thermal head holders 62 (62*a*, 62*b*) move upward and downward as mentioned above, the film cartridge 14 also moves upward and downward, and thus the film 11 can abut and separate from the platen roller 7. Note that, the engagement force between the locking hooks 71 for fixing and the locking holes 33 are set such that a user can easily release the engagement when the thermal head unit 50 is to be opened.

As mentioned above, in the surface processing apparatus 100 of this embodiment, the thermal head (heating device) 8 is pressed against the platen 7 via the film 11 which is pulled out from the feed shaft 12 and taken up by the take-up shaft 13 so as to be conveyed. Then, the surface of the medium S is heated via the film 11 by the thermal head 8 at the pressing portion T. That is, the surface processing apparatus 100 of this embodiment includes the platen 7 disposed at a position where the thermal head 8 in the apparatus main body can be pressed via the film 11 against the platen 7. The surface processing apparatus 100 includes the heating unit 50. The heating unit 50 includes the thermal head 8, and the shutter 55 which can move between a first position (closing position) where the shutter 55 covers the surface of the thermal head 8 on the side to be pressed against the platen and a second position (opening position) where the surface of the thermal head 8 is opened. The heating unit 50 mentioned above includes the unit positioning portions (heating unit positioning portions) 54*a*, 54*b* which position the thermal head 8 with respect to the platen 7. The surface processing apparatus 100 of this embodiment includes the film cartridge 14 which is detachably mounted to the main body 1 of the surface processing apparatus 100. The film cartridge 14 includes the casing 31 which contains the film 11 which can be taken up from the feed shaft 12 by the take-up shaft 13. The casing 31 includes the first opening portion 80 into which the heating unit 50 proceeds and the second opening portion 81 through which the surface of the film 11, which is opposite to the surface thereof with which the thermal head 8 is brought into contact, exposes to the platen 7. The film cartridge 14 mentioned above includes the cartridge positioning portions 38*a*, 38*b* for positioning the casing 31 with respect to the platen 7. The film cartridge 14 mentioned above includes, in the casing 31, the operational portions 37*a*, 37*b* which act on the shutter 55 of the heating unit 50 to move the shutter 55 between the first position (closing position) and the second position (opening position). Then, the heating unit 50 proceeds into the casing 31 through the first opening portion 80 under a state in which the shutter 55 is at the first position (closing position), and the operational portions 37*a*, 37*b* act on the shutter 55 in the casing 31 to move the shutter 55 to the second position (opening position).

As mentioned above, in this embodiment, the film cartridge 14 includes the operational portions 37*a*, 37*b* which are disposed in the casing 31 so as to act on the shutter 55 of the heating unit 50 to move the shutter 55 between the first position (closing position) and the second position (opening position). The operational portions 37*a*, 37*b* are disposed so that, when the heating unit 50 proceeds into the casing 31 through the first opening portion 80 in a state in which the shutter 55 is at the first position, the operational portions 37*a*, 37*b* act on the shutter 55 in the casing 31 to move the shutter 55 to the second position.

Note that, in this embodiment, the thermal head holders 62 are movably mounted on the positioning holders 51. However, this embodiment is not limited to this mode. For example, the thermal head holders 62 may be immovably fixed to the positioning holders 51 in a case where the thermal head 8 is configured to neither abut nor separate from the platen 7.

As mentioned above, according to this embodiment, a film can be easily replaced without an adhesion of dust or the like to the surface of the film or the surface of the thermal head (heating device) when the film is being replaced.

Second Embodiment

Next, another embodiment will be described. In this embodiment, as to elements having functions or configurations identical with or corresponding to those of the surface processing apparatus of the first embodiment, the same reference symbols as those of the first embodiment are used, and detailed explanations are omitted.

Figure 20:
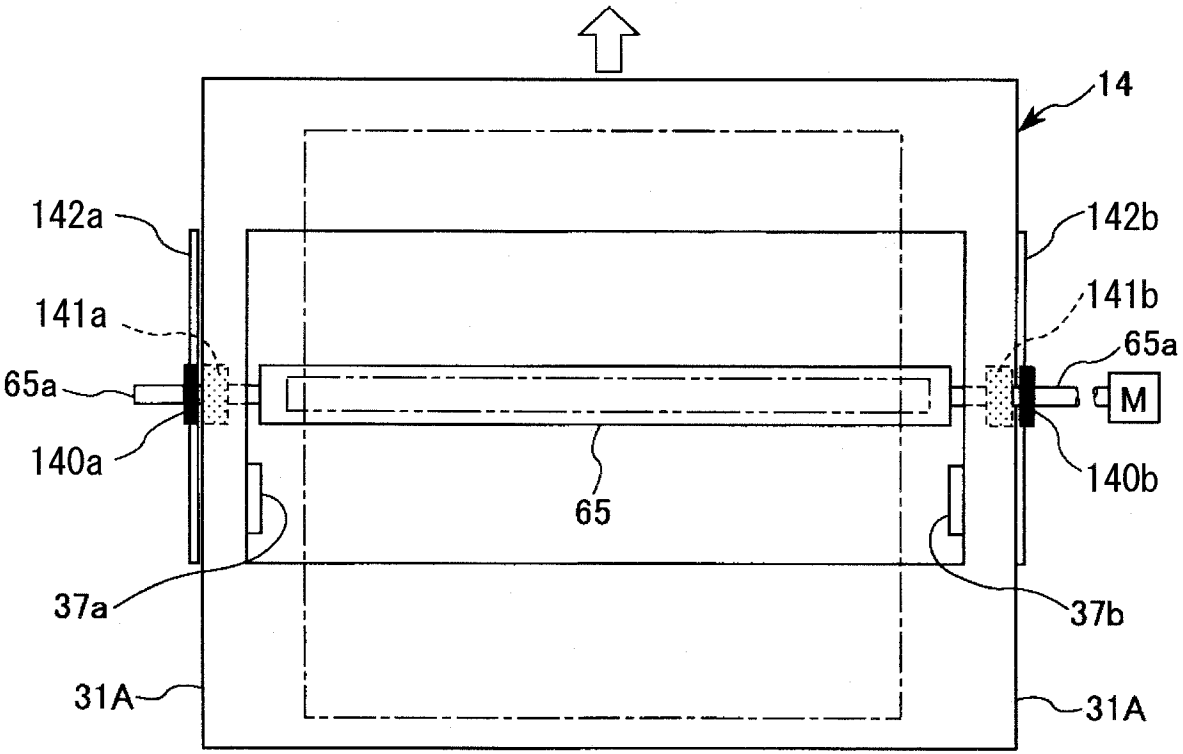
FIG. 20 is a top view illustrating a state in which a film cartridge according to another embodiment of the present invention is set in the conveying unit provided in the main body of the surface processing apparatus.
Figure 21:
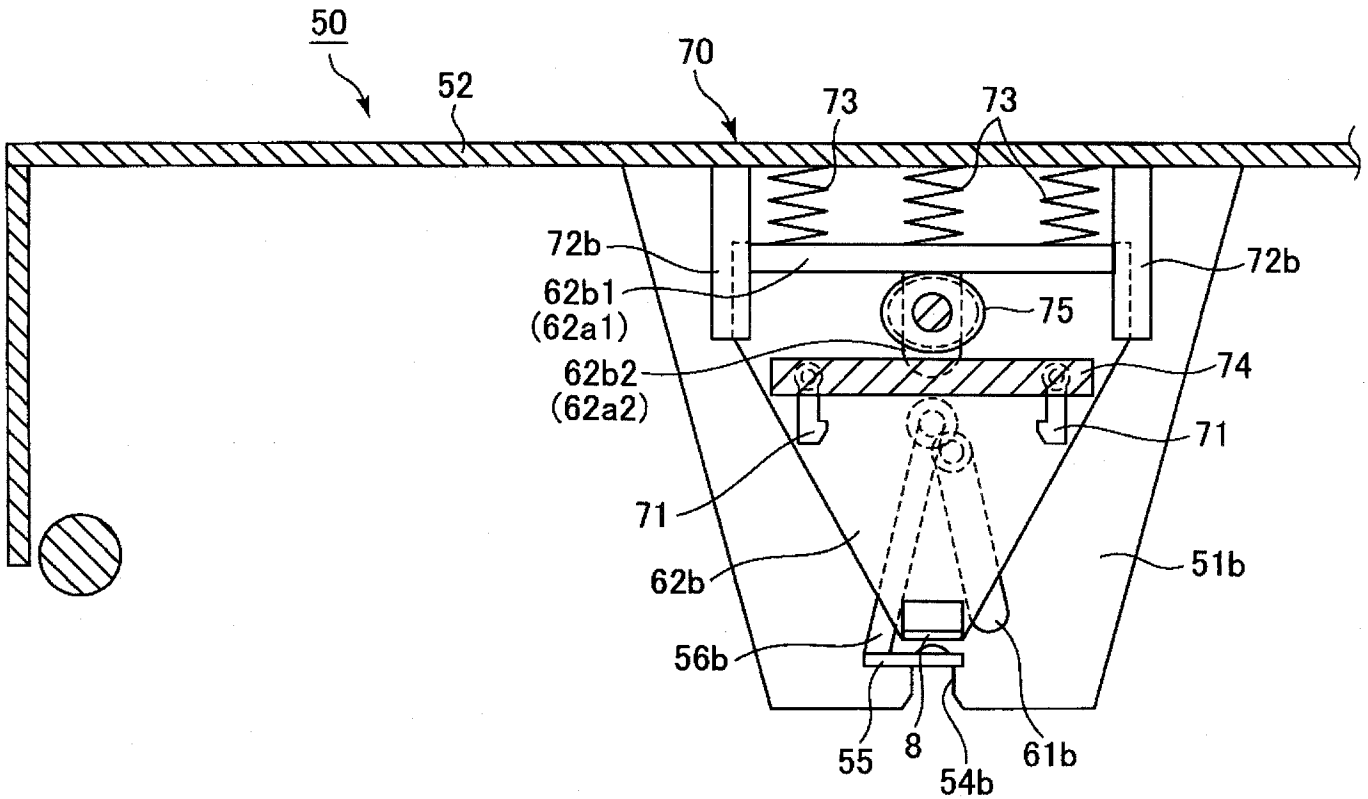
FIG. 21 is a cross-sectional view illustrating in more detail a part of a thermal head unit according to the another embodiment cut near the central portion in the left-right direction.
Figure 22:
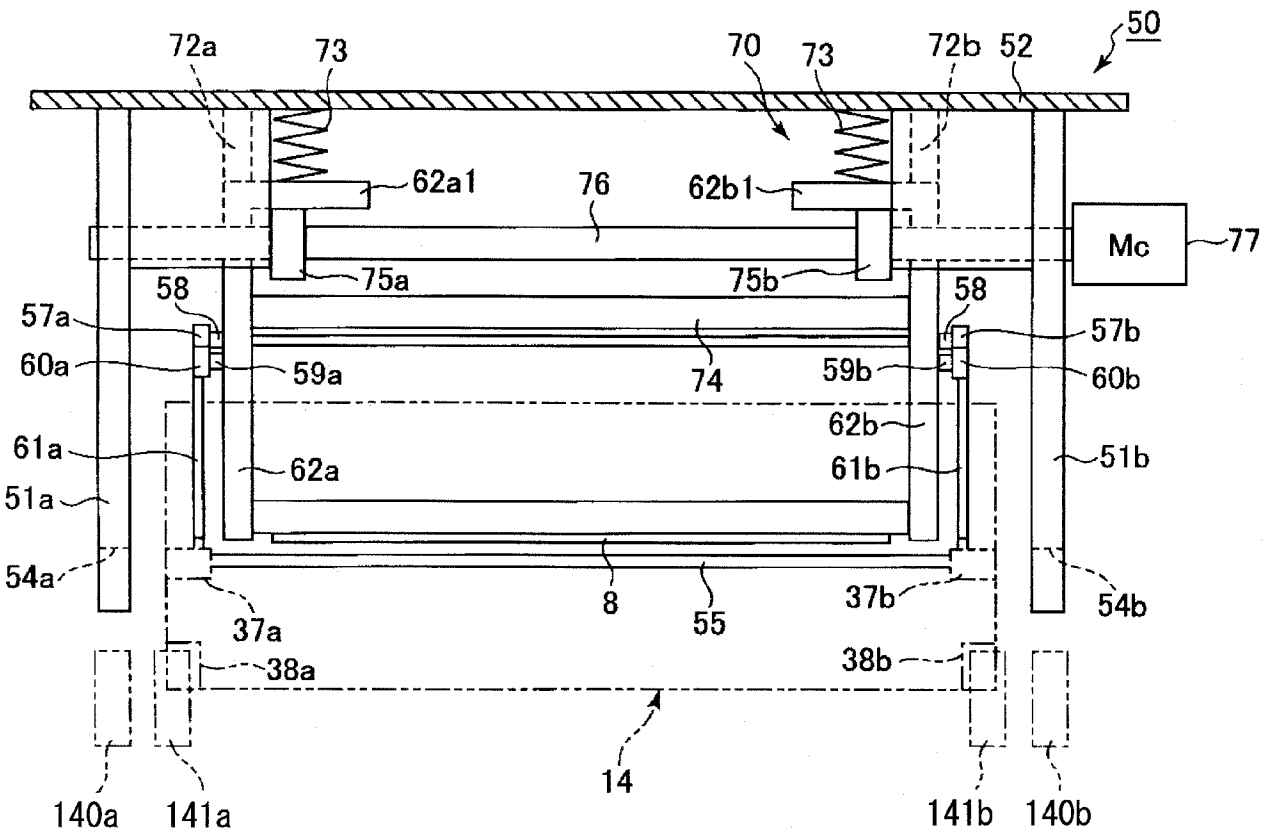
FIG. 22 is a partial cross-sectional side view of the thermal head unit according to the another embodiment viewed from the feeding side.

FIG. 20 is a schematic top view illustrating a state in which the film cartridge 14 is set on the conveying unit 110 (including the platen roller 7, the registration roller pair 5, and the conveying roller pair 9) provided in the apparatus main body 1 of the surface processing apparatus 100 in this embodiment. FIG. 21 is a cross-sectional view illustrating in more detail a part of the thermal head unit 50 cut near the central portion in left-right direction in this embodiment. FIG. 22 is a partial cross-sectional side view of the thermal head unit 50 in this embodiment viewed from the feeding side.

In the first embodiment, the positioning portions of the thermal head 8 with respect to the platen roller 7 are disposed within the film cartridge 14. However, this embodiment is not limited to the mode, and the positioning portions may be disposed outside the film cartridge 14.

As illustrated in FIG. 20, in this embodiment, frames 142 (142*a*, 142*b*) of the conveying unit 110 are disposed outside the film cartridge 14. Bearings 141 (141*a*, 141*b*) attached to the shaft 7*a* of the platen roller 7 are configured to fit into the positioning portions 38 (38*a*, 38*b*) of the film cartridge 14. In addition, similarly to the first embodiment, the additional positioning portions 39 (39*a*, 39*b*) are rested on the receiving portions 43 (43*a*, 43*b*) which are disposed at the conveying unit 110 (FIG. 11). With this, the film cartridge 14 is positioned.

In this embodiment, as illustrated in FIG. 22, the left and right positioning holders 51 (51*a*, 51*b*) of the thermal head unit 50 are fitted onto the frames 142 (142*a*, 142*b*) (FIG. 20) of the conveying unit 110, from the outside. In addition, the left and right unit positioning portions (54*a*, 54*b*) formed on the left and right positioning holders 51 (51*a*, 51*b*) fit onto the bearings 140 (140*a*, 140*b*) attached to the shaft 7*a* of the platen roller 7, respectively. With this, when the thermal head unit 50 proceeds into the film cartridge 14 so as to become the enabled state, the thermal head 8 is positioned with respect to the platen roller 7.

In this embodiment, the shutter shaft 58 is rotatably disposed between the thermal head holders 62 (62*a*, 62*b*) which proceed into the film cartridge 14. The driving shafts 59 (59*a*, 59*b*), the shutter shaft gears 57 (57*a*, 57*b*), and the driving gears 60 (60*a*, 60*b*) are also disposed on the thermal head holders 62 (62*a*, 62*b*), respectively. Moreover, the shutter holders 56 (56*a*, 56*b*) and the shutter levers 61 (61*a*, 61*b*) are also disposed on the thermal head holders 62 (62*a*, 62*b*), respectively.

Note that, in this embodiment, as illustrated in FIG. 21, the left and right thermal head holders 62 (62*a*, 62*b*) are provided with the through holes 62*a*2, 62*b*2 for the movement of the switching shaft 76 when the thermal head holders 62 (62*a*, 62*b*) move upward and downward. In this embodiment, when the left and right thermal head holders 62 (62*a*, 62*b*) move upward and downward, the shutter 55 and the opening and closing mechanism for the shutter 55 also move upward and downward. In this embodiment, at this time, the opening and closing operational portions 37 (37*a*, 37*b*) are positioned in the film cartridge 14 so that the shutter 55 does not disturb the abutting and separating motions of the thermal head 8.

The configuration of this embodiment can also provide the effects similar to those of the first embodiment. In this embodiment, because the positioning portions of the thermal head unit 50 exist outside the film cartridge 14, dust or the like is less liable to adhere to a surface of a film when replacing the film.

Third Embodiment

Next, still another embodiment will be described. In this embodiment, as to elements having functions or configurations identical with or corresponding to those of the surface processing apparatus of the first and second embodiments, the same reference symbols as those of the first and second embodiments are used, and detailed explanations are omitted.

In the first and second embodiments, the surface processing apparatus is an individual surface processing apparatus for performing surface processing to a medium to be processed which is a recording material on which an image is formed separately by an electrophotographic image forming apparatus. However, the surface processing apparatus may be connected to the electrophotographic image forming apparatus, and a recording material on which an image has been formed by the image forming apparatus may be conveyed to the surface processing apparatus as a medium to be processed.

Figure 23:
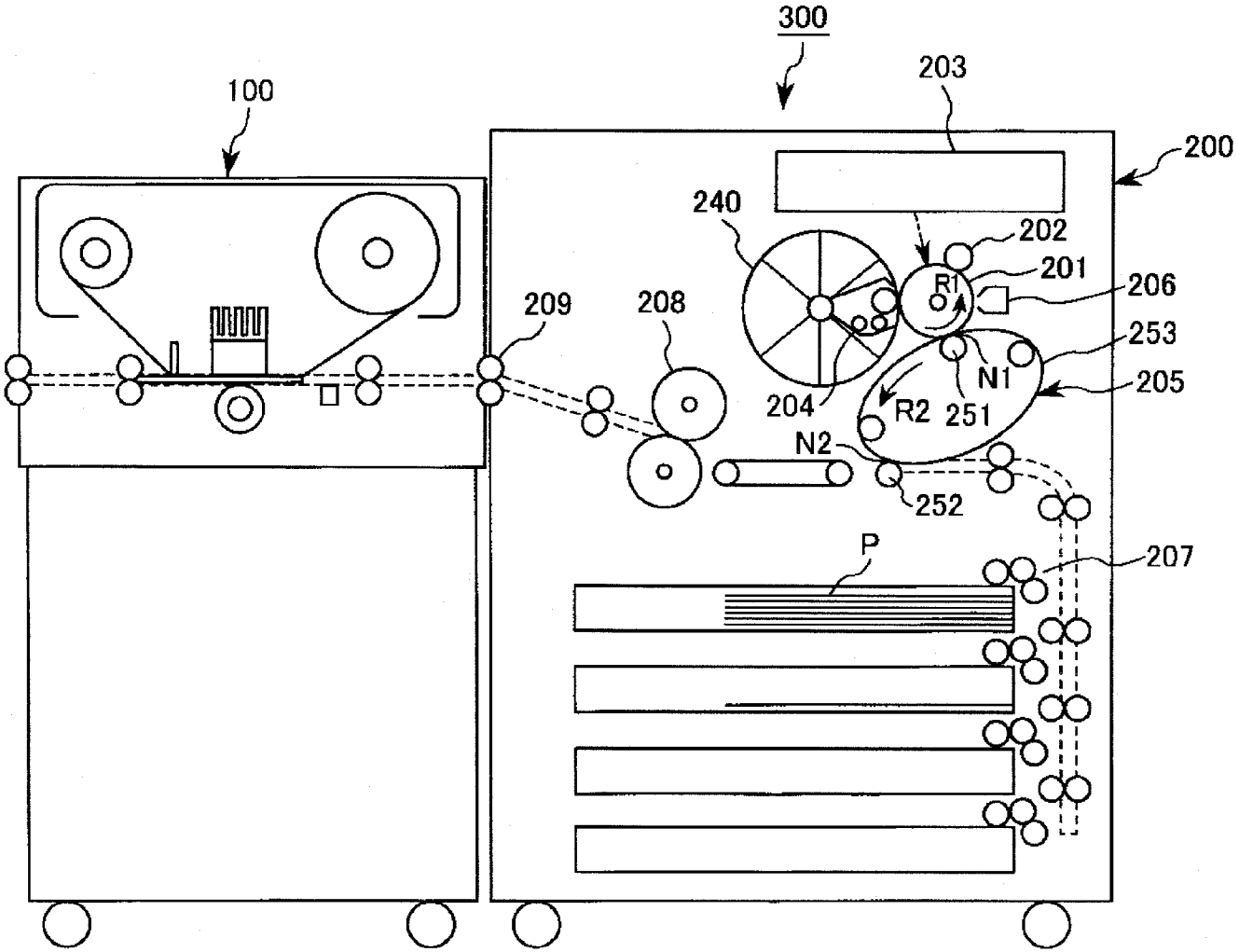
FIG. 23 is a schematic cross-sectional view of an image forming system including the surface processing apparatus according to the embodiment.

FIG. 23 is a schematic cross-sectional view illustrating a whole configuration of an image forming system including the surface processing apparatus according to the embodiment. In this embodiment, the surface processing apparatus 100 is connected to an image electrophotographic forming apparatus 200 so as to constitute an image forming system 300. The image forming system 300 forms, in the image forming apparatus 200, an image with thermofusible toner by the electrophotographic method on a recording material P, such as recording paper, and conveys the recording material P to the surface processing apparatus 100 which is connected to downstream of the image forming apparatus 200 in the conveying direction of the recording material P. The surface processing apparatus 100 performs processing (surface processing) for controlling the surface characteristics of the surface of the recording material P, on which the image has been formed, as the medium S, and outputs the medium S after processing.

In this embodiment, the image forming apparatus 200 is a one-drum type image forming apparatus adopting an intermediate transfer system which forms a full color image by using the electrophotographic method.

The image forming apparatus 200 includes a photosensitive drum 201 which is a drum-shaped electrophotographic photosensitive member (photosensitive member) as an image bearing member. The photosensitive drum 201 is driven to rotate in the direction indicated by the arrow R1 shown in FIG. 23. Around the photosensitive drum 201, the following elements are disposed in the rotational direction in order of mention. First, a charging roller 202 as a charging unit is provided. Next, an exposure device (laser scanner) 203 as an exposure unit is provided. Next, a rotary developing apparatus 240 including a plurality of developing devices 204 and serving as a developing unit is provided. Next, an intermediate transfer unit 205 as a transfer unit is provided. Next, a drum cleaner 206 as a photosensitive member cleaning unit is provided.

The intermediate transfer unit 205 includes an endless intermediate transfer belt 253 as an intermediate transfer member, which opposes the photosensitive drum 201. The intermediate transfer belt 253 is wrapped around a plurality of tension rollers to be tensioned and is driven to rotate in the direction indicated by the arrow R2 shown in FIG. 23. On the inner circumferential surface side of the intermediate transfer belt 253, there is disposed a primary transfer roller 251 as a primary transfer unit at a position opposing the photosensitive drum 201 so that a primary transfer portion (primary transfer nip) N1 where the intermediate transfer belt 253 is in contact with the photosensitive drum 201 is formed. On the outer circumferential surface side of the intermediate transfer belt 253, a secondary transfer roller 252 as a secondary transfer unit is disposed so as to form a secondary transfer portion (secondary transfer nip) N2 by being brought into contact with the intermediate transfer belt 253.

In this embodiment, the rotary developing apparatus 240 includes a developing device 204 which uses a clear (transparent) toner in addition to developing devices 204 which use toners of colors of CMYK, respectively. Because the surface processing apparatus 100 provides gloss by re-heating a toner image so as to transfer the surface characteristics of the film 11 to the toner image, it is difficult to sufficiently provide gloss on an image portion having relatively small amount of toner. Accordingly, clear toner is used to an image portion having relatively small amount of toner and margins, etc., so that gloss processing can be performed also to such portions. Note that, because the toner is clear, an original full color image is not affected.

Toner of four colors of YMCK is made of fine powders having main components of resin and pigments, and clear toner is made of fine powders having main components of resin without pigment. In this embodiment, a polyester resin is used as the resin constituting toner.

The image forming apparatus 200 is configured to further include a feeding portion 207 which feeds the recording material P, a fixing portion 208 which fixes a toner image on the recording material P, and a delivery portion 209 which conveys the recording material P from the image forming apparatus 200 to the surface processing apparatus 100.

The image forming apparatus 200 having the configuration can form a full color image including clear toner by operations similar to those of a general of an electrophotographic image forming apparatus. A case of forming a full color image including clear toner will be described as an example. During image formation, a surface of the rotating photosensitive drum 201 is uniformly charged by the charging roller 202. When an image signal of separated colors is input to the exposure device 203, the charged surface of the photosensitive drum 201 is scanned to be exposed in accordance with the image signal. With this, an electrostatic latent image (electrostatic image) is formed on the photosensitive drum 201 in accordance with the image signal. The electrostatic latent image formed on the photosensitive drum 201 is supplied with toner of corresponding color by the developing device 204 corresponding to the subject separated color so as to be developed as a toner image. The toner image formed on the photosensitive drum 201 is primarily transferred to the intermediate transfer belt 253 by the action of the primary transfer roller 251. The steps of charging, exposure, development, and primary transfer are respectively repeated for necessary separated colors (here, YMCK and clear) so that a plurality of primarily transferred toner images are primarily transferred onto the intermediate transfer belt 253 so as to be superimposed on top of the other to form a multilayer toner image. The toner images formed on the intermediate transfer belt 253 are secondarily transferred onto the recording material P collectively by the action of the secondary transfer roller 252.

The recording material P is conveyed from the feeding portion 207 to the secondary transfer portion N2 in synchronization with the plurality of toner images on the intermediate transfer belt 253. The secondary transfer roller 252 abuts against the intermediate transfer belt 253 in synchronization with the timing. The recording material P onto which the toner images have been transferred is conveyed to the fixing apparatus 208 to be heated and pressured, thereby fixing the toner images on the recording material P. Toner remained on the photosensitive drum 201 after the primary transfer process is removed by the drum cleaner 206 so as to be collected. Toner remained on the intermediate transfer belt 253 after the secondary transfer process is removed by a cleaning unit (not shown) so as to be collected. The recording material P on which the image has been fixed is conveyed to the surface processing apparatus 100 through the delivery portion 209 as the medium S to be processed by the surface processing apparatus 100.

The surface processing apparatus 100 is connected to the delivery portion 209 of the image forming apparatus 200. Therefore, the image forming system 300 of this embodiment does not include a delivery tray, which is generally mounted on the delivery portion of the image forming apparatus 200, and a feeding device (cassette 2 and feed roller 3), which is generally mounted on the feeding portion of the surface processing apparatus 100.

The configuration of the surface processing apparatus 100 is substantially the same as those of the first and second embodiments. However, in this embodiment, as mentioned above, the cassette 2 and the feed roller 3 of the surface processing apparatus 100 of the first and second embodiments are not disposed, and the recording material P on which an image has already been formed is conveyed directly from the image forming apparatus 200 as the medium S. In this embodiment, the controller 500 of the surface processing apparatus 100 can communicate with a controller (controlling portion) (not shown) of the image forming apparatus 200. In this embodiment, the controller 500 can control the motions of respective portions of the surface processing apparatus 100 based on processing instructions input from the image forming apparatus 200, or processing instructions input by the operating portion 600 disposed on the surface processing apparatus 100. The processing instructions include processing region information for causing the thermal head 8 to selectively generate heat in synchronization with the timing when a corresponding region of the medium S passes through the processing portion T. The thermal head 8 generates heat correspondingly to a given position of the medium S based on the processing region information to perform surface processing of the medium S. Similarly to the first and second embodiments, the controller 500 may be configured so that processing instructions are input from an external apparatus such as a personal computer.

The recording material P having an image of full colors including clear toner, which is delivered from the delivery portion 209 of the image forming apparatus 200, is conveyed as the medium S to the conveying roller pair 4 of the surface processing apparatus 100. Gloss processing similar to that described in the first embodiment is performed to the medium S conveyed to the conveying roller pair 4.

When the gloss processing is performed in an in-line mode as mentioned above, the processing capacity of the surface processing apparatus 100 is desirably higher than the printing processing capacity of the image forming apparatus 200. When the processing capacity of the surface processing apparatus 100 is lower than the printing capacity of the image forming apparatus 200, the printing capacity of the image forming apparatus 200 needs to be adjusted to the processing capacity of the surface processing apparatus 100 by, for example, lowering the printing speed of the image forming apparatus 200, or reserving a space between adjacent sheets.

Through connection of the surface processing apparatus 100 to the delivery portion 209 of the image forming apparatus 200 as mentioned above, the gloss processing can be performed in an in-line mode so that the productivity can be enhanced when producing a printed matter to which gloss processing is applied. Moreover, it is possible to connect a post processing apparatus for bookbinding, sorting, or the like, on the downstream side of the surface processing apparatus 100.

When the surface processing apparatus mentioned above is adopted to the image forming system 300, effects similar to those of the first and second embodiments mentioned above can be obtained.

Others

In the embodiments mentioned above, a case in which gloss is partially applied to a surface of a medium is described. Meanwhile, a printed matter may be required to exhibit a metallic appearance, such as gold or silver, as a characteristic feature. In a thermal transfer printer using a thermal head, as ink of metallic color, for example, a metallic layer may be deposited on a film, and the metallic layer may be transferred by heat, to thereby form a metallic image. The film used in a thermal transfer method includes a film substrate and an ink layer coated on the film substrate. The ink layer may be coated on the film substrate via a release layer, or an adhesive layer may be disposed on the ink layer. The above-mentioned embodiments can be applied to a surface processing apparatus and a film cartridge, capable of partially heat-transferring a characteristic image onto a surface of a medium to be processed by heating with the thermal head, using a characteristic film, such as a film on which ink of metallic color, e.g., gold or silver, is deposited. Concretely, the term of surface processing of a medium includes a case where ink of metallic color is partially heat-transferred to a surface of a medium to be processed so as to apply a metallic appearance, e.g., metallic gloss, to the surface. That is, the film may have a surface roughness on its surface layer, which is different from the surface roughness of the thermoplastic resin image surface on the medium to be processed, or may be coated with ink which is to be fused by heating to be transferred onto the medium to be processed. As mentioned above, the idea of the subject application can be applied to a surface processing apparatus and a film cartridge thereof, capable of partially controlling surface characteristics of a surface of a medium to be processed by heating via a film, or partially heat-transferring thermally fusible ink on a film onto a surface of a medium.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-097682, filed Apr. 25, 2011, which is hereby incorporated by reference herein in its entirety.

What is claimed is:

1. A processing apparatus which processes a surface of a sheet, the processing apparatus comprising:

a cartridge which contains a film which is pulled out from a feed shaft and taken up by a take-up shaft so as to be conveyed;

a heating device which heats the sheet via the film;

a mechanism which movably supports the heating device, the mechanism assuming a first attitude in which the heating device abuts against the film and a second attitude in which the heating device is separated from the film; and a shutter which covers a film abutting surface of the heating device, wherein the cartridge is provided with a first opening into which the heating device is proceedable and a second opening through which the film is brought into contact with the sheet, and wherein the heating device proceeds into the cartridge through the first opening in a state in which the heating device is covered with the shutter, and the shutter retracts from the film abutting surface of the heating device inside the cartridge.

2. A processing apparatus according to claim 1, wherein the shutter is biased by an action of gravity to a position in which the shutter covers the film abutting surface of the heating device, and the shutter retracts from the film abutting surface by abutting an abutting portion disposed in the cartridge.

3. A processing apparatus according to claim 1, further comprising a seal which opens and closes the first opening, wherein the seal is opened by the shutter being brought into contact with the seal when the heating device proceeds into the first opening, and the seal is closed when the heating device moves out of the first opening.

4. A cartridge which is detachably mountable to a processing apparatus as recited in claim 1.

* * * * *